US012146260B2

(12) United States Patent
Kim et al.

(10) Patent No.: US 12,146,260 B2
(45) Date of Patent: Nov. 19, 2024

(54) APPARATUS FOR CONTROLLING CLOTHES TREATING APPARATUS, CLOTHES TREATING APPARATUS AND METHOD FOR CONTROLLING CLOTHES TREATING APPARATUS

(71) Applicant: LG Electronics Inc., Seoul (KR)

(72) Inventors: Seonghwan Kim, Seoul (KR); Haeyoon Je, Seoul (KR); Ingeun Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 1134 days.

(21) Appl. No.: 16/992,767

(22) Filed: Aug. 13, 2020

(65) Prior Publication Data

US 2021/0047773 A1 Feb. 18, 2021

(30) Foreign Application Priority Data

Aug. 14, 2019 (KR) ..... 10-2019-0099755
Jul. 3, 2020 (KR) ..... 10-2020-0082304

(51) Int. Cl.

| | |
|---|---|
| ***D06F 58/20*** | (2006.01) |
| ***D06F 34/28*** | (2020.01) |
| ***D06F 58/24*** | (2006.01) |
| ***D06F 58/38*** | (2020.01) |
| ***D06F 58/45*** | (2020.01) |
| ***D06F 103/00*** | (2020.01) |
| ***D06F 103/32*** | (2020.01) |

(Continued)

(52) U.S. Cl.

CPC ..... *D06F 58/206* (2013.01); *D06F 34/28* (2020.02); *D06F 58/38* (2020.02); *D06F 58/45* (2020.02); *D06F 58/24* (2013.01); *D06F 2103/00* (2020.02); *D06F 2103/32* (2020.02); *D06F 2105/08* (2020.02); *D06F 2105/26* (2020.02); *D06F 2105/30* (2020.02)

(58) Field of Classification Search

CPC ..... D06F 58/206; D06F 34/28; D06F 58/38; D06F 58/45; D06F 58/24; D06F 2103/00; D06F 2103/32; D06F 2105/081; D06F 2105/26; D06F 2105/30; D06F 58/36; D06F 58/20

See application file for complete search history.

(56) References Cited

U.S. PATENT DOCUMENTS

2018/0030643 A1 2/2018 Kim et al.

FOREIGN PATENT DOCUMENTS

CN 101769662 A * 7/2010
CN 102677439 9/2012

(Continued)

OTHER PUBLICATIONS

Translation, CN-101769662-A, Jul. 2010 (Year: 2010).*

(Continued)

*Primary Examiner* — Jessica Yuen
(74) *Attorney, Agent, or Firm* — Fish & Richardson P.C.

(57) ABSTRACT

An apparatus for controlling a clothes treating apparatus, the clothes treating apparatus, and a method for controlling the clothes treating apparatus configured to sterilize an evaporator by stopping an operation of a compressor under a specific condition to allow a surface temperature of the evaporator to be at or above a reference temperature due to thermal equilibrium caused by the stopping of the operation of the compressor.

9 Claims, 25 Drawing Sheets

(51) Int. Cl.

| | |
|---|---|
| ***D06F 105/08*** | (2020.01) |
| ***D06F 105/26*** | (2020.01) |
| ***D06F 105/30*** | (2020.01) |

(56) References Cited

FOREIGN PATENT DOCUMENTS

| | | | |
|---|---|---|---|
| CN | 105297370 | | 2/2016 |
| CN | 107687079 | | 2/2018 |
| CN | 109914065 | | 6/2019 |
| JP | 2007105238 | | 4/2007 |
| JP | 2008006068 | | 1/2008 |
| JP | 2008200082 | | 9/2008 |
| JP | 2014119154 A | * | 6/2014 |
| KR | 20130127816 | | 11/2013 |

OTHER PUBLICATIONS

Translation, JP-2014119154-A (Year: 2014).*
Office Action in Australian Appln. No. 2022279405, mailed on Mar. 19, 2024, 4 pages.
EP Extended European Search Report in European Appln. No. 20190976.9, dated Mar. 16, 2021, 10 pages.
Office Action in Chinese Appln. No. 202010818475.7, dated Jun. 29, 2022, 19 pages (with English translation).

* cited by examiner

*FIG. 10*

| RESULT OF DETERMINATION | | REFERENCE CONDITIONS |
|---|---|---|
| TEMPERATURE CHANGE | EVAPORATOR AIR IN | #1 |
| | EVAPORATOR AIR OUT | #2 |
| | EVAPORATOR REFRIGERANT IN | #3 |
| | EVAPORATOR REFRIGERANT OUT | #4 |
| | CONDENSER AIR IN | #5 |
| | CONDENSER AIR OUT | #6 |
| | CONDENSER REFRIGERANT IN | #7 |
| | CONDENSER REFRIGERANT OUT | #8 |
| | ... | ... |
| OPERATING STATE | OPERATING TIME | #9 |
| | OPERATING SECTION | #10 |
| | OPERATING FREQUENCY | #11 |
| | ... | ... |

FIG. 11B

| CONDITIONS | | LIVE BACTERIA | DEATH RATE (%) |
|---|---|---|---|
| EARLY BACTERIA | | $2.0\times10^{9}$ | - |
| 60℃ | 10 MINUTES | $1.4\times10^{5}$ | 99.992 |
| | 20 MINUTES | $6.7\times10^{2}$ | 99.999 |
| | 30 MINUTES | 0 | 100 |
| 70℃ | 10 MINUTES | 0 | 100 |
| | 20 MINUTES | 0 | 100 |
| | 30 MINUTES | 0 | 100 |
| 80℃ | 10 MINUTES | 0 | 100 |
| | 20 MINUTES | 0 | 100 |
| | 30 MINUTES | 0 | 100 |

APPARATUS FOR CONTROLLING CLOTHES TREATING APPARATUS, CLOTHES TREATING APPARATUS AND METHOD FOR CONTROLLING CLOTHES TREATING APPARATUS

CROSS-REFERENCE TO RELATED APPLICATIONS

Pursuant to 35 U.S.C. § 119(a), this application claims the benefit of the earlier filing date and the right of priority to Korean Patent Application No. 10-2019-0099755, filed on Aug. 14, 2019, and Korean Patent Application No. 10-2020-0082304, filed on Jul. 3, 2020, the contents of which are incorporated by reference herein in their entirety.

BACKGROUND

1. Technical Field

Disclosed is about a clothes treating apparatus that performs a drying function, a control apparatus and a control method for controlling the same.

2. Description of the Related Art

A background technology of the embodiments disclosed in the present specification relates to a clothes treating apparatus to dry clothes or bedding.

The clothes treating apparatus performing the drying function removes moisture from an object for drying by supplying hot air into a drum while the object for drying such as clothes or bedding is accommodated in the drum. The hot air supplied into the drum is generated by electric resistance heat, combustion heat using gas fuel, or a condenser that configures a heat pump cycle, and the generated hot air is supplied into the drum by a circulation fan. The air that has dried the moisture from the object for drying then discharged from the drum retains the moisture of the object for drying and becomes hot and humid. Here, a type of the dryer is classified into a condensation type and an exhaust type according to a method for treating the hot and humid air.

The condensation type dryer does not discharge hot and humid air to outside, but condenses moisture contained in the hot and humid air through heat exchange while circulating the air. On the other hand, the exhaust type dryer directly discharges hot and humid air to the outside. The condensation type dryer and the exhaust type dryer have structural differences in that the condensation type dryer has a structure to treat condensate and the exhaust type dryer has a structure to exhaust air.

Meanwhile, Korean Patent Publication No. 10-2013-0127816 (published on Nov. 25, 2013), which is a prior patent document, discloses a condensation type dryer equipped with a heat pump system, but such a dryer has a problem of contamination caused by condensate. Specifically, condensate is generated in the evaporator as humidity of air that has dried the object while passing through the drum decreases. And, since the condensate may have contaminants or bacteria that has been contained in the drum and the object for drying, it may contaminate configurations through which the condensate passes. For example, bacteria may remain in at least one of an evaporator, a water container, a cleaning portion, and a pump. As such, when the configuration of the heat pump system is contaminated by bacteria or the like, odors caused by bacteria may remain in the air circulating through a flow path, and these odors stay in the object for drying, which may cause a problem of deterioration in drying quality. In addition, large amount of condensate generated in the evaporator creates an environment favorable for reproduction of bacteria, and contamination of the evaporator by bacteria is inevitably accelerated.

As such, the heat pump system configuration of the dryer may be contaminated by bacteria or contaminants generated in the heat exchange process, and such a contaminated state can be resolved only when a user cleans the configuration of the heat pump system. However, due to the structure of the dryer, the heat pump system provided therein could not be easily cleaned, and limitations such as an inconvenience are inevitably caused as a user him or herself needs to clean the heat pump system.

That is, in the related art dryer, contamination caused by bacteria occurs during the heat pump cycle process, but a method for preventing or eliminating contamination by bacteria has not been prepared, and as a result, the performance, hygiene and drying quality of the dryer, and user's convenience and satisfaction were not satisfied.

SUMMARY

The present disclosure is intended to provide an apparatus for controlling a clothes treating apparatus, the clothes treating apparatus, and a control method of the clothes treating apparatus that can overcome the limitations in the related art as described above.

Specifically, the present disclosure is to provide embodiments of an apparatus for controlling a clothes treating apparatus, the clothes treating apparatus, and a control method of the clothes treating apparatus capable of sterilizing an evaporator by an operation of the clothes treating apparatus itself and preventing contamination of the evaporator.

That is, the embodiments of the present disclosure make it a technical task to automatically sterilize the evaporator without a separate means or artificial process for sterilization.

In addition, the present disclosure is intended to provide embodiments of an apparatus for controlling a clothes treating apparatus, the clothes treating apparatus, and a method for controlling the clothes treating apparatus capable of effectively sterilizing the evaporator.

An apparatus for controlling a clothes treating apparatus, the clothes treating apparatus, and a method for controlling the clothes treating apparatus according to the present disclosure have solutions for the above problems by controlling an operation of a compressor to allow a surface temperature of an evaporator to stay at or above a reference temperature in which a sterilization is performed.

Specifically, by using a principle of thermal equilibrium in a heat exchanger depending on whether or not the compressor is driven, the operation of the compressor is stopped at a specific condition so that the surface temperature of the evaporator is at or above the reference temperature, and the evaporator is sterilized at or above the reference temperature.

That is, embodiments of the apparatus for controlling the clothes treating apparatus, the clothes treating apparatus, and the control method of the clothes treating apparatus according to the present disclosure are to solve the above problems by technical features to sterilize the evaporator at or above a reference temperature by stopping the operation of the compressor under a specific condition to allow the surface temperature of the evaporator to be at or above a reference temperature due to thermal equilibrium caused by the stopping of the operation of the compressor.

The technical features described above may be implemented by being applied to the apparatus for controlling the clothes treating apparatus, a micro controller of the clothes treating apparatus, the clothes treating apparatus, a control method of the clothes treating apparatus, a control method of the control apparatus of the clothes treating apparatus, a control method for sterilizing the clothes treating apparatus, or a sterilizing operation method of the clothe treating apparatus. And the present disclosure provides embodiments of the apparatus for controlling the clothes treating apparatus, the clothes treating apparatus, and the control method of the clothes treating apparatus having the above technical features as a solution.

An embodiment of the apparatus for controlling clothes treating apparatus having the technical features as a solution is a control apparatus for controlling the clothes treating apparatus including a drum rotatably installed inside a main body that defines an exterior, and into and from which an air to dry an object flows in and out, a heat exchanger provided at an air circulation passage connected to the drum and including an evaporator and a condenser that exchange heat with air circulating in the air circulation passage, and a compressor configured to compress a refrigerant, the control apparatus includes a driving unit configured to drive the compressor and a controller (control unit) configured to control an operation of the compressor, wherein the controller controls the operation of the compressor so that a surface temperature of the evaporator is to be at or above a predetermined reference temperature.

In addition, another embodiment of the apparatus for controlling clothes treating apparatus having the technical features as a solution is a control apparatus for controlling the clothes treating apparatus including a drum rotatably installed inside a main body that defines an exterior, and into and from which an air to dry an object flows in and out, a heat exchanger provided at an air circulation passage connected to the drum and including an evaporator and a condenser that exchange heat with air circulating in the air circulation passage, and a compressor configured to compress a refrigerant, the control apparatus includes a detecting unit configured to detect a temperature of the heat exchanger and a controller configured to control an operation of the compressor so that the refrigerant is compressed and circulated according to the detection result of the detecting unit, wherein the controller controls the operation of the compressor when the sterilizing operation is performed on the evaporator so that the evaporator is sterilized at or above the reference temperature.

In addition, an embodiment of the clothes treating apparatus having the technical features as a solution includes a drum rotatably installed inside a main body of the clothes treating apparatus, a heat exchanger provided at an air circulation passage connected to the drum and including an evaporator and a condenser that exchange heat with air circulating in the air circulation passage, a compressor configured to compress a refrigerant that is circulated through the heat exchanger and exchanges heat with air circulating in the air circulation passage, input elements in which a control input for an operation mode of the clothes treating apparatus is applied, and a control apparatus configured to control an operation of the drum or an operation of the compressor, or both, so that an operation according to the operation mode is performed in response to the control input, wherein the control apparatus is configured such that, when a control input on a specific mode for controlling a surface temperature of the evaporator is applied, the control apparatus drives the compressor, then stops the operation of the compressor when at least one of a temperature change of the evaporator and an operating state of the compressor corresponds to a predetermined reference condition to allow the surface temperature to be at or above a predetermined reference temperature.

In addition, another embodiment of the clothes treating apparatus having the technical features as a solution includes a drum rotatably installed inside a main body of the clothes treating apparatus, a heat exchanger provided at an air circulation passage connected to the drum and including an evaporator and a condenser that exchange heat with air circulating in the air circulation passage, a compressor configured to compress a refrigerant that is circulated through the heat exchanger and exchanges heat with air circulating in the air circulation passage, input elements in which a control input for an operation mode of the clothes treating apparatus is applied, and a control apparatus configured to control an operation of the drum or an operation of the compressor, or both, so that an operation according to the operation mode is performed in response to the control input, wherein the control apparatus is configured such that, when a control input for a sterilization mode for sterilizing the evaporator is applied, the control apparatus drives the compressor until at least one of the temperature change of the evaporator and the operating state of the compressor corresponds to a predetermined reference condition, then stops the operation of the compressor to allow the surface temperature to be at or above a reference temperature, so that the evaporator is sterilized at or above the reference temperature.

In addition, an embodiment of a method for controlling the clothes treating apparatus having the technical features as a solution including a heat exchanger provided at an air circulation passage connected to a drum and including an evaporator and a condenser that exchange heat with air circulating in the air circulation passage, and a circulation fan configured to generate a flow of air flowing through the condenser then flowing into the drum, the method includes driving the compressor and the circulation fan, stopping the operation of the compressor when a temperature change of the evaporator or an operating state of the compressor, or both, meet a predetermined reference condition, and maintaining the stopping the operation of the compressor for a predetermined reference time.

In addition, another embodiment of the method for controlling the clothes treating apparatus having the technical features as a solution including a drum rotatably installed inside a main body that defines an exterior, a heat exchanger provided at an air circulation passage connected to the drum and including an evaporator and a condenser that exchange heat with air circulating in the air circulation passage, a compressor configured to compress a refrigerant that is circulated through the heat exchanger and exchanges heat with air circulating in the air circulation passage, a circulation fan configured to generate a flow of air flowing through the condenser then flowing into the drum, a cleaning portion configured to spray cleaning water to clean a surface of the evaporator toward the surface of the evaporator, and a valve portion having a plurality of cleaning water ports to form a part of a path through which the cleaning water flows, the method includes entering a control input for performing a sterilization mode to sterilize the evaporator, driving the drum, spraying the cleaning water on the evaporator according to a predetermined reference for spraying by controlling the valve portion, driving the compressor and the circulation fan, maintaining the operation of the compressor until at least one of a temperature change of the evaporator and an operating state of the compressor corresponds to a predetermined reference condition, stopping the operation of the compressor when at least one of the temperature change of the evaporator and the operating state of the compressor corresponds to the reference condition, and maintaining the stoppage of the operation of compressor for a predetermined reference time.

In the apparatus for controlling the clothes treating apparatus, the clothes treating apparatus, and the method for controlling the clothes treating apparatus according to the embodiments, sterilization of the evaporator can be effectively performed by controlling the surface temperature of the evaporator to be at or above a reference temperature in which sterilization is performed.

In addition, in the apparatus for controlling the clothes treating apparatus, the clothes treating apparatus, and the method for controlling the clothes treating apparatus according to the embodiments, the evaporator can be sterilized in a simple manner without a separate configuration/means for a sterilizing operation by controlling the operation of the compressor to allow the surface temperature of the evaporator to be at or above the reference temperature in which sterilization is performed.

In addition, the evaporator can be automatically sterilized without artificial cleaning.

Accordingly, contamination of the evaporator can be easily and conveniently prevented, and contamination of an object for drying and deterioration of the performance of the clothes treating apparatus due to contamination of the evaporator can also be prevented.

As a result, the embodiments of the apparatus for controlling the clothes treating apparatus, the clothes treating apparatus, and the method for controlling the clothes treating apparatus of the present disclosure can overcome the limitations in the related art, and also enhance convenience, hygiene, reliability and utility of the clothes treating apparatus.

BRIEF DESCRIPTION OF THE DRAWINGS

FIG. 10 is an exemplary view illustrating examples of reference conditions according to an embodiment.

FIG. 11B is an exemplary view 2 explaining a principle of high-temperature sterilization related to an embodiment.

DETAILED DESCRIPTION

Hereinafter, description will be given in detail of embodiments disclosed herein. Technical terms used in this specification are merely used for explaining specific embodiments, and should not be constructed to limit the scope of the technology disclosed herein.

In addition, technical terms used in this specification should be interpreted as meanings generally understood by those skilled in the art in the field to which the technology disclosed in this specification belongs, unless otherwise defined in the specification, and it should not be interpreted as a comprehensive meaning or an excessively reduced meaning.

Hereinafter, in order to help the understanding of the embodiments of this specification, firstly, [BASIC CONFIGURATION OF CLOTHES TREATING APPARATUS] related to the embodiments will be described, then each embodiment of [APPARATUS FOR CONTROLLING CLOTHES TREATING APPARATUS], [CLOTHES TREATING APPARATUS], and [METHOD FOR CONTROLLING CLOTHES TREATING APPARATUS] will be described separately.

[Basic Configuration of Clothes Treating Apparatus]

Firstly, a basic configuration of a clothes treating apparatus to which an embodiment of this specification is applied will be described.

Hereinafter, a clothes treating apparatus according to an embodiment will be described in detail with reference to the accompanying drawings. For the sake of brief description with reference to the drawings, the same or equivalent components will be provided with the same reference numbers, and description thereof will not be repeated. A singular representation may include a plural representation unless it represents a definitely different meaning from the context.

It will be understood that when an element is referred to as being "connected with" another element, the element can be connected with the another element or intervening elements may also be present. In contrast, when an element is referred to as being "directly connected with" another element, there are no intervening elements present.

Figure 1:
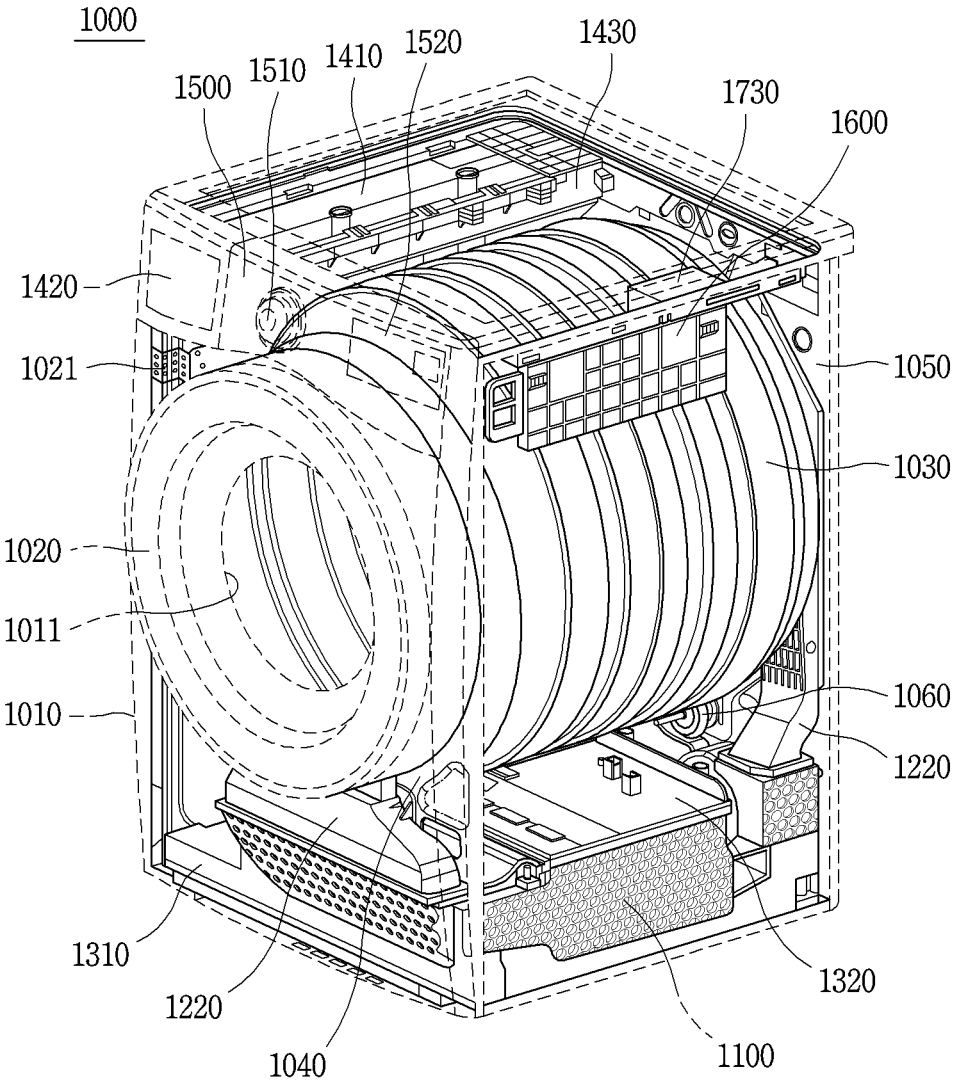
FIG. 1 is an exemplary view illustrating an example of a structure of a clothes treating apparatus according to an embodiment.

FIG. 1 is a conceptual view of a clothes treating apparatus 1000 according to an embodiment.

A cabinet 1010 defines an appearance of the clothes treating apparatus 1000. A plurality of metal plates constituting a front surface portion, a rear surface portion, left and right side surface portions, an upper surface portion, and a lower surface portion of the clothes treating apparatus 1000 are combined with each other to form the cabinet 1010. A front opening 1011 is formed at a front surface portion of the cabinet 1010 so that an object for treating can be introduced into a drum 1030.

A door 1020 is configured to open and close the front opening 1011. The door 1020 may be rotatably connected to the cabinet 1010 by a hinge 1021. The door 1020 may be made of a partially transparent material. Therefore, even when the door 1020 is closed, inside of the drum 1030 may be visually exposed through the transparent material.

The drum 1030 is rotatably installed inside the cabinet 1010. The drum 1030 is defined in a cylindrical shape to accommodate objects for treating. The drum 1030 is placed to face front and rear directions of the clothes treating apparatus 1000 so as to receive objects for treating through the front opening 1011. An unevenness may be formed along a circumference on an outer circumferential surface of the drum 1030.

The drum 1030 has openings opened toward front and rear sides of the clothes treating apparatus 1000. Objects for treating may be introduced into the drum 1030 through the front opening. Hot and dry air may be introduced into the drum 1030 through a rear opening.

The drum 1030 is rotatably supported by a front supporter 1040, a rear supporter 1050, and a roller 1060. The front supporter 1040 is disposed below a front side of the drum 1030, and the rear supporter 1050 is disposed at a rear side of the drum 1030.

The front supporter 1040 and the rear supporter 1050 may be connected to the cabinet 1010 by fastening of a connection member 1013 or the like. For example, the cabinet 1010 may include a pillar 1012 extending vertically at a position adjacent to both corners of the front supporter 1040. One part of the connection member 1013 may be disposed to face the front supporter 1040, and another part of the connection member 1013 may be bent several times from the one part to surround the pillar 1012. When screws are fastened through the connection member 1013 and the front supporter 1040, the connection member 1013 and the front supporter 1040 are connected. Similarly, when the screws are fastened through the connection member 1013 and the pillar 1012, the connection member 1013 and the pillar 1012 are connected. In addition to screws, a variety of connection mechanisms may be applied.

The roller 1060 may be installed at the front supporter 1040 and the rear supporter 1050, respectively. The roller 1060 is disposed right below the drum 1030 and is in contact with the outer circumferential surface of the drum 1030. The roller 1060 is configured to be rotatable, and an elastic member such as rubber is coupled to an outer circumferential surface of the roller 1060. The roller 1060 rotates in a direction opposite to a rotation direction of the drum 1030.

Heat pump cycle devices 1100 may be installed under the drum 1030. Here, the under the drum 1030 means a lower portion in a space between the outer circumferential surface of the drum 1030 and an inner circumferential surface of the cabinet 1010. The heat pump cycle devices 1100 refer to devices that configure a cycle to sequentially evaporate, compress, condense, and expand refrigerant. When the heat pump cycle devices 1100 are operated, air becomes hot and dry while sequentially exchanging heat with an evaporator 1111 and a condenser 1112.

An inlet duct 1210 and an outlet duct 1220 have a flow path configured to circulate the hot and dry air generated by the heat pump cycle devices 1100 to the drum 1030. The inlet duct 1210 is disposed at the rear side of the drum 1030, and the air that became hot and dry by the heat pump cycle devices 1100 is supplied to the drum 1030 through the inlet duct 1210. The outlet duct 1220 is disposed at a lower front side of the drum 1030, and air that has dried the object for treating is recovered again through the outlet duct 1220.

A filter 1070 is disposed between the front supporter 1040 and the outlet duct 1220. An upper portion of the filter 1070 is mounted on a filter mounting portion (not shown) provided on the front supporter 1040, and a lower portion of the filter 1070 is inserted into the outlet duct 1220. Dust or lint generated while the hot and dry air dries the object for treating is filtered by the filter 1070.

A connecting duct 1230 and a circulation fan cover 1330 are disposed between the inlet duct 1210 and the outlet duct 1220.

An inlet of the connecting duct 1230 is connected to the outlet duct 1220. The connecting duct 1230 is configured to surround the evaporator 1111 and the condenser 1112 corresponding to the heat exchanger 1110 among the heat pump cycle devices 1100. An outlet of the connecting duct 1230 is connected to the circulation fan cover 1330.

An inlet of the circulation fan cover 1330 is connected to the outlet of the connecting duct 1230. The circulation fan cover 1330 is configured to accommodate the circulation fan therein. An outlet of the circulation fan cover 1330 is connected to the inlet duct 1210.

A base 1310 is installed at a lower side of the drum 1030 and the heat pump cycle devices 1100. The base 1310 means a molded body that supports various components of the clothes treating apparatus 1000 including the heat pump cycle devices 1100 from the lower side.

A base cover 1320 is installed between the base 1310 and the drum 1030. The base cover 1320 is configured to cover the heat pump cycle devices 1100 mounted on the base 1310. When a side wall of the base 1310 and the base cover 1320 are combined, an air circulation passage is formed. Some of the heat pump cycle devices 1100 are installed in the air circulation passage.

A water container 1410 is disposed on an upper left side or an upper right side of the drum 1030. Here, the upper left side or the upper right side of the drum 1030 means an upper left portion or an upper right portion in the space between the outer circumferential surface of the drum 1030 and the inner circumferential surface of the cabinet 1010. In FIG. 1, the water container 1410 is disposed on the upper left side of the drum 1030. In the water container 1410, condensate is collected.

When air that has dried objects for treating is recovered through the outlet duct 1220 to exchange heat with the evaporator 1111, condensate is generated. More specifically, when the temperature of the air decreases due to heat exchange in the evaporator 1111, a saturation amount of water vapor that the air can contain decreases. Since the air recovered through the outlet duct 1220 contains moisture exceeding the saturation amount of water vapor, condensate is inevitably generated.

A water pump 1440 (see, FIG. 3) is installed inside the clothes treating apparatus 1000. The water pump 1440 pumps up the condensate up to the water container 1410. The condensate is collected in the water container 1410.

A water container cover 1420 may be disposed at one corner of the front surface portion of the clothes treating apparatus 1000 to correspond to a position of the water container 1410. The water container cover 1420 is formed to be gripped by hand, and is placed on a front surface of the clothes treating apparatus 1000. When pulling the water container cover 1420 to empty the condensate collected in the water container 1410, the water container 1410 is withdrawn from a water container support frame 1430 together with the water container cover 1420.

The water container support frame 1430 is configured to support the water container 1410 inside the cabinet 1010. The water container support frame 1430 extends along a direction of insertion or withdrawal of the water container 1410 to guide the insertion or withdrawal of the water container 1410.

An input/output panel 1500 may be disposed next to the water container cover 1420. The input/output panel 1500 may include an input unit 1510 to receive a selection of a clothes treating course from a user, and an output unit 1520 visually displaying an operating state of the clothes treating apparatus 1000. The input unit 1510 may be configured as a jog dial, but is not limited thereto. The output unit 1520 may be configured to visually display the operating state of the clothes treating apparatus 1000, and the clothes treating apparatus 1000 may have a separate configuration for audible display in addition to the visual display.

The controller 1600 is configured to control an operation of the clothes treating apparatus 1000 based on a user input applied through the input unit 1510. The controller 1600 may include a printed circuit board and elements mounted on the printed circuit board. When a user selects a clothes treating course through the input unit 1510 and inputs a control command such as operating of the clothes treating apparatus 1000, the controller 1600 controls the operation of the clothes treating apparatus 1000 according to a preset algorithm.

The printed circuit board constituting the controller 1600 and the elements mounted on the printed circuit board may be disposed on the upper left side or the upper right side of the drum 1030. In FIG. 1, the printed circuit board is disposed on the upper right side of the drum 1030, which is an opposite side of the water container 1410. Considering that condensate is collected in the water container 1410, that air containing moisture is flowing through the heat pump cycle devices 1100 and ducts 1210, 1220, and 1230, and that electrical products such as printed circuit boards and elements are vulnerable to water, it is preferable that the printed circuit board and elements are separated as far as possible from the water container 1410 or the heat pump cycle devices 1100.

An interior space of the cabinet 1010 may be divided into a first space I and a second space II based on the drum 1030. The first space I is a cylindrical space enclosed by the drum 1030, and is a space accommodating objects for treating such as clothes. The second space II is an annular space between the cabinet 1010 and the drum 1030, and is a space in which electrical components and mechanism structures of the clothes treating apparatus 1000 are installed. The space between the cabinet 1010 and the drum 1030 means the second space II.

When the cylindrical drum 1030 is installed inside the cabinet 1010 having a hexahedral shape as a whole, areas in which electrical components, mechanism structures, etc. can be installed between the cabinet 1010 and the drum 1030 can be said to be four corners at outer sides of the drum 1030 when the clothes treating apparatus 1000 is viewed from the front.

The evaporator 1111 corresponding to the heat exchanger 1110, the condenser 1112, and the connecting duct 1230 enclosing the heat exchanger 1110 are eccentrically installed at one side under the drum 1030 to occupy one of the four corners. A compressor 1120, a drum motor 1800, a blower 1820, etc. are eccentrically installed at another side under the drum 1030 to occupy another one of the four corners. The printed circuit board constituting the controller 1600 is eccentrically installed at one side above the drum 1030 to occupy still another one of the four corners. The water container 1410 is eccentrically installed at another side above the drum 1030 to occupy last one of the four corners.

According to this arrangement, the blower 1820, the connecting duct 1230, the printed circuit board constituting the controller 1600, and the water container 1410 do not overlap each other in forward and backward direction of the clothes treating apparatus 1000. In addition, by such an arrangement, conditions are provided to maximize a size of the drum 1030 inside the cabinet 1010 with limited space by efficiently utilizing an inner space of the clothes treating apparatus 1000.

In particular, the embodiments of the present specification relate to the clothes treating apparatus 1000 having a drum of a larger size than the related art drum. For example, a cross-sectional area of the drum 1030, which can be calculated in an area of a circle, may be 330,000 $mm^2$ to 360,000 $mm^2$.

Hereinafter, the drum 1030 and the air circulation passage will be described.

Figure 2:
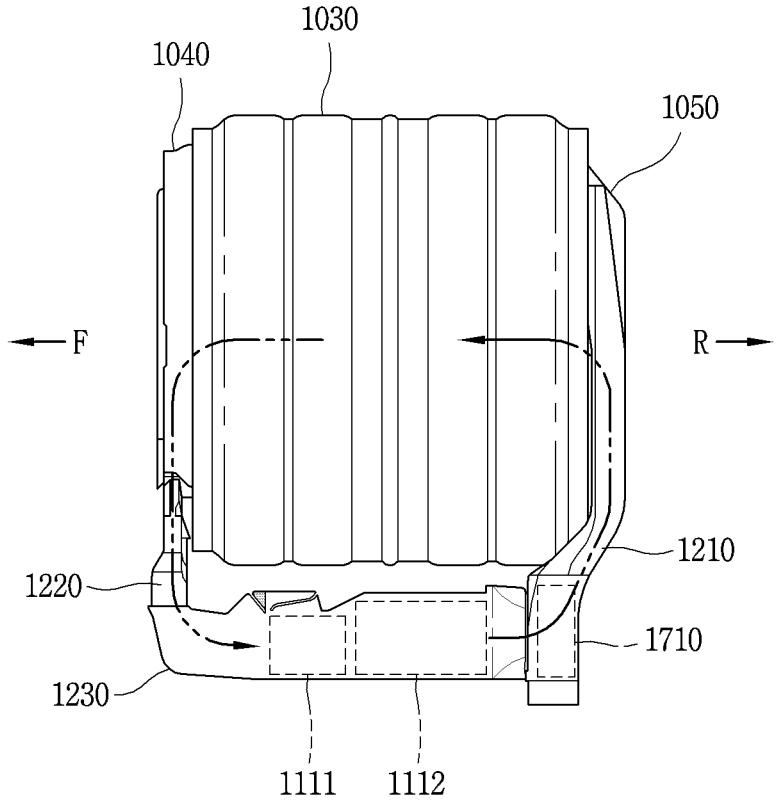
FIG. 2 is a side view of a drum and an air circulation passage in a clothes treating apparatus according to an embodiment.

FIG. 2 is a side view of the drum 1030 and the air circulation passage. In FIG. 2, a left side corresponds to a front side F of the drum 1030, and a right side corresponds to a rear side R of the drum 1030.

In order to dry clothes (object for treating) put into the drum 1030, a process of supplying hot and dry air to the interior of the drum 1030, recovering the air that has dried the clothes, and removing moisture from the air shall be repeated. In order to repeat this process in a condensation type dryer, air must continuously circulate through the drum 1030. The circulation of air is made through the drum 1030 and the air circulation passage.

The air circulation passage is connected to the front opening of the drum 1030 and the rear opening of the drum 1030. The air circulation passage forms a path through which air discharged from the front opening of the drum 1030 passes through the heat exchanger 1110 and flows into the rear opening of the drum.

The air circulation passage is formed by the inlet duct 1210, the outlet duct 1220, and the connecting duct 1230 disposed between the inlet duct 1210 and the outlet duct 1220. Each of the inlet duct 1210, the outlet duct 1220, and the connecting duct 1230 may be formed by combining a plurality of members.

The inlet duct 1210, the drum 1030, the outlet duct 1220, and the connecting duct 1230 are sequentially connected based on the flow of air, and the connecting duct 1230 is again connected to the inlet duct 1210 to form a closed flow path.

The inlet duct 1210 extends from the connecting duct 1230 to a rear surface of the rear supporter 1050. The rear surface of the rear supporter 1050 refers to a surface facing a rear side of the clothes treating apparatus 1000. Since the drum 1030 and the connecting duct 1230 are spaced apart from each other along a vertical direction, the inlet duct 1210 may have a structure extending in the vertical direction from the connecting duct 1230 disposed under the drum 1030 to the rear side of the drum 1030.

The inlet duct 1210 is coupled to the rear surface of the rear supporter 1050. A hole is formed at the rear surface of the rear supporter 1050. Therefore, hot and dry air is supplied from the inlet duct 1210 to the interior of the drum 1030 through the hole formed at the rear supporter 1050.

The outlet duct 1220 is disposed under the front supporter 1040. Since the front opening for inletting the object for treating shall be provided at the front side of the drum 1030, the outlet duct 1220 is disposed at a lower portion of the front side of the drum 1030.

The outlet duct 1220 extends from the front supporter 1040 to the connecting duct 1230. The outlet duct 1220 may be extended in the vertical direction like the inlet duct 1210, but an extended length of the outlet duct 1220 in the vertical direction is shorter than that of the inlet duct 1210. The air that has dried the object for treating in the drum 1030 is recovered into the connecting duct 1230 through the outlet duct 1220.

The evaporator 1111 and the condenser 1112 among the heat pump cycle devices 1100 are installed inside the connecting duct 1230. In addition, a circulation fan 1710 to supply hot and dry air to the inlet duct 1210 is also installed inside the connecting duct 1230. Based on a flow of air, the evaporator 1111 is disposed at an upstream side of the condenser 1112 and the circulation fan 1710 is disposed at a downstream side of the condenser 1112.

The circulation fan 1710 generates suction power to suck air from the air circulation passage to supply the air to the drum. The circulation fan 1710 sucks air from the condenser 1112 and generates wind in a direction to the inlet duct 1210. The circulation fan 1710 is provided inside the circulation fan cover 1330. The inlet of the circulation fan cover 1330 is connected to the connecting duct 1230, and the outlet of the circulation fan cover 1330 is connected to an inlet of the inlet duct 1210.

Next, components under the drum 1030 will be described.

Figure 3:
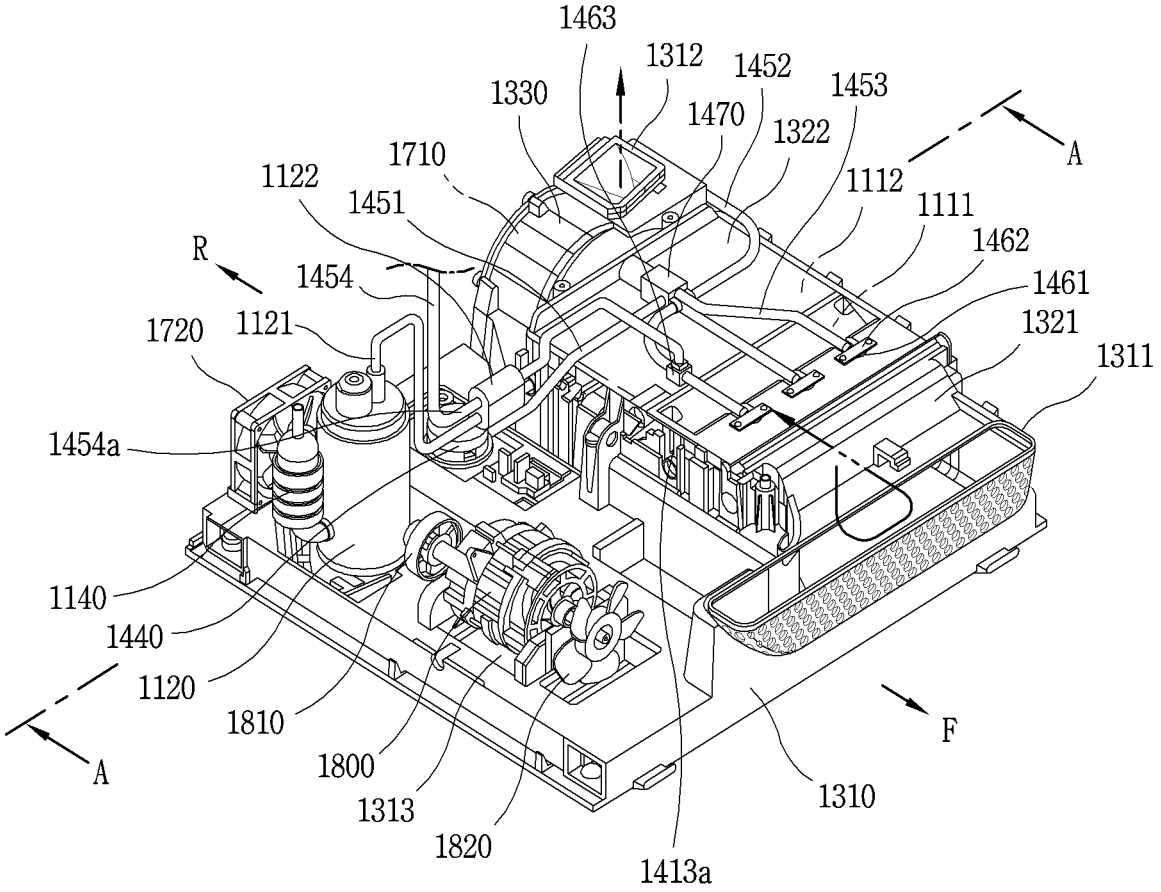
FIG. 3 is a perspective view of a base and components mounted to the base in a clothes treating apparatus according to an embodiment.
Figure 4:
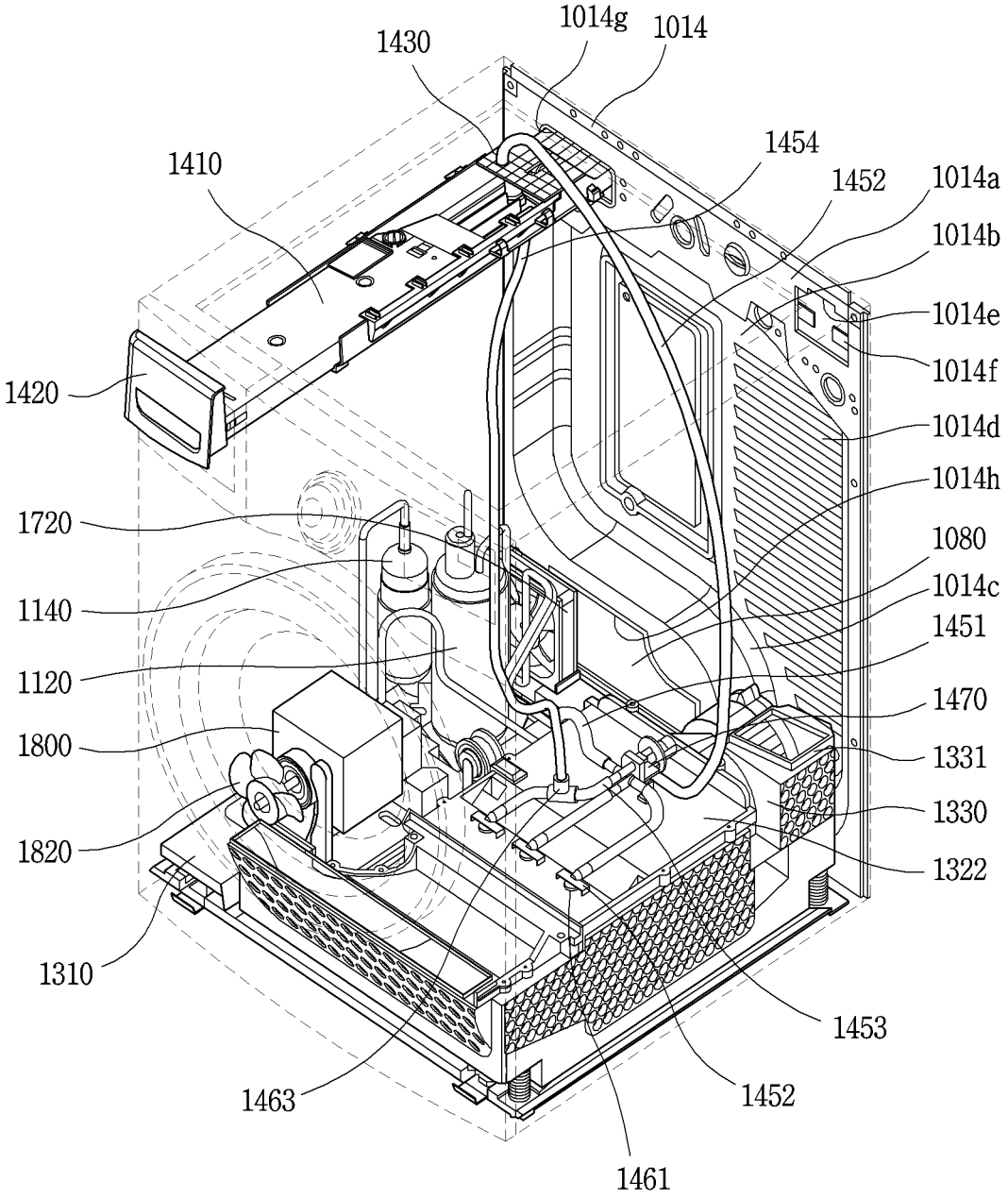
FIG. 4 is a perspective view illustrating an internal configuration of a clothes treating apparatus according to an embodiment.

FIG. 3 is a perspective view of the base 1310 and components mounted to the base 1310. In FIG. 3, F indicates the front side of the clothes treating apparatus 1000, and R indicates the rear side of the clothes treating apparatus 1000. FIG. 4 is a perspective view illustrating an internal configuration of the clothes treating apparatus 1000.

The base 1310 is configured to support mechanical elements of the clothes treating apparatus 1000, including heat pump cycle devices 1100. The base 1310 includes a plurality of mounting portions 1313 to mount the mechanical elements. The mounting portions 1313 refer to regions provided to mount the mechanical elements. Each mounting portion 1313 may be partitioned from each other by steps of the base 1310. Hereinafter, components will be described in a counterclockwise direction based on the connecting duct 1230.

Unlike the drum 1030 disposed in a center based on a left-right direction of the clothes treating apparatus 1000, the air circulation passage is eccentrically disposed at the left side or the right side of the drum 1030. In FIG. 3, the air circulation passage is disposed on a lower right side of the drum 1030. The eccentric arrangement of the air circulation passage is for efficient drying of the object for treating and efficient arrangement of the components.

An inlet portion 1311 of the connecting duct 1230 is disposed below the outlet duct 1220 and is connected to the outlet duct 1220. The inlet portion 1311 of the connecting duct 1230 is configured to guide air together with the outlet duct 1220 in an inclined direction. For example, in FIG. 3, the inlet portion 1311 of the connecting duct 1230 becomes narrower as it goes downward. In particular, a left surface of the inlet portion 1311 is inclined to a lower right side. When the air circulation passage is disposed at the lower left side of the drum 1030, a right surface of the inlet portion 1311 will be formed to be inclined to the lower left side.

The evaporator 1111, the condenser 1112, and the circulation fan 1710 are sequentially arranged on a downstream side of the inlet portion 1311 based on the flow of air. When the clothes treating apparatus 1000 is viewed from the front, the condenser 1112 is disposed behind the evaporator 1111 and the circulation fan 1710 is disposed behind the condenser 1112. The evaporator 1111, the condenser 1112, and the circulation fan 1710 are mounted on each mounting portion 1313 provided on the base 1310.

The base cover 1320 may be installed on the evaporator 1111 and the condenser 1112. The base cover 1320 may include a single member or multiple members. When the base cover 1320 includes multiple members, the base cover 1320 may include a front base cover 1321 and a rear base cover 1322.

The base cover 1320 is configured to cover the evaporator 1111 and the condenser 1112. A part of the connecting duct 1230 may be formed in a manner of the base cover 1320 being coupled to the steps or side walls of the base 1310 formed at a left side and a right side of the evaporator 1111 and the condenser 1112.

The circulation fan 1710 is enclosed by the base 1310 and the circulation fan cover 1330. An outlet portion 1331 of the circulation fan cover 1330 is formed at an upper side of the circulation fan 1710. The outlet portion 1313 is connected to the inlet duct 1210. The hot and dry air generated by the heat pump cycle devices 1100 is supplied to the drum 1030 through the inlet duct 1210.

The circulation fan 1710 is disposed at a most rear side in the cabinet 1010. The circulation fan 1710 is disposed at a downstream side of the condenser 1112 based on the flow of air. The circulation fan 1710 may be configured as a centrifugal fan. The centrifugal fan is configured to suck air in an axial direction and blow the air in a radial direction. When a rotating shaft of the circulation fan 1710 is disposed to extend toward the condenser 1112, the condenser 1112 is disposed in a direction in which the rotating shaft of the circulation fan 1710 extends.

The circulation fan 1710 sucks hot and dry air from the condenser 1112. And the hot and dry air sucked by the circulation fan 1710 is blown out to the outlet 1331 of the circulation fan cover 1330 provided at the upper side of the circulation fan 1710. The centrifugal fan forms a strong air volume and a fast wind speed based on a strong suction power compared to an axial fan.

The water pump 1440 is installed at one side of the condenser 1112 (or one side of the circulation fan 1710). The water pump 1440 is configured to transfer condensate collected to the mounting portion where the water pump 1440 is installed.

The base 1310 is configured to drain condensate generated during an operation of the heat pump cycle devices 1100 to a collecting portion 1414 in which the water pump 1440 is installed. For example, a bottom surface of the mounting portion 1313 may be inclined to allow condensate to flow to the mounting portion where the water pump 1440 is installed, or a stepped height of the collecting portion 1414 in which the water pump 1440 is installed may be partially low.

When air circulating through the drum exchanges heat with the heat exchanger 1110, condensation occurs and condensate drops to a bottom of a heat exchanger mounting portion. A bottom of a mounting portion of the evaporator 1111 and the condenser 1112 is inclined downwardly in a direction from the evaporator 1111 toward the condenser 1112. Accordingly, the condensate is collected in the mounting portion at a lower portion of the condenser 1112. Here, the mounting portion in which the condenser 1112 is installed is provided adjacent to the collecting portion 1414 in which the water pump 1440 is installed with a partition wall forming the air circulation passage therebetween.

The partition wall has a flow path penetrating the partition wall so that the condensate collected in the mounting portion where the condenser 1112 is installed flows to the collecting portion 1414. The collecting portion 1414 is provided at a height lower than a bottom of the mounting portion of the heat exchanger 1110. Therefore, the flow path is inclined downwardly as it goes from the collecting portion 1414 to the mounting portion of the heat exchanger 1110.

With this configuration of the base 1310, the condensate collected in the collecting portion 1414 in which the water pump 1440 is installed can be transferred to the water container 1410 by the water pump 1440 or drained outside. In addition, the condensate may be transferred by the water pump 1440 and used for cleaning the evaporator 1111 or the condenser 1112.

The water pump 1440 is connected to a control valve 1470 by an outlet hose 1451. When the water pump 1440 operates, the condensate collected in a water collecting portion 1315 is transferred to the control valve 1470. The control valve 1470 is configured to distribute the condensate transferred by the water pump 1440 to various hoses 1452 and 1453.

The hoses 1452 and 1453 connected to the control valve 1470 may be made of a flexible material. Each of the hoses 1452 and 1453 may be referred to as a condensate supply hose in a sense of supplying condensate. For convenience of explanation, an ordinal number is added to each of the hoses 1452 and 1453.

A first hose 1452 is connected to the control valve 1470 and the water container 1410. The first hose 1452 is not directly connected to the water container 1410, but is connected to the water container 1410 through an upper portion of the water container support frame 1430. A hole facing a water container hole 1412 at the water container 1410 is formed at an upper portion of the water container support frame 1430. When the water container 1410 is inserted into the water container support frame 1430, the two holes are arranged to face each other. A sealing member may be coupled between the two holes or around the two holes.

When the condensate transferred by the water pump 1440 flows to the first hose 1452 by an operation of the control valve 1470, the condensate flows into the water container 1410 through the first hose 1452. The condensate is temporarily stored in the water container 1410 until a user empties the water container 1410.

The second hose 1453 is connected to the control valve 1470 and a condensate spray portion 1461. The condensate spray portion 1461 is configured to spray condensate to a surface of the evaporator 1111 or a surface of the condenser 1112. Dust or foreign matter may adhere to the surfaces of the evaporator 1111 and the condenser 1112 due to an accumulation of the operating time of the clothes treating apparatus 1000. Dust or foreign substances cause the efficiency of the heat exchange between the evaporator 1111 and the condenser 1112 to decrease, and thus need to be quickly removed.

When the condensate is supplied to the condensate spray portion 1461 through the second hose 1452, the condensate spray portion 1461 sprays the condensate to the evaporator 1111 or the condenser 1112.

To this end, a spray port of the condensate spray portion 1461 is disposed to face the evaporator 1111 or the condenser 1112. When the condensate is sprayed to the evaporator 1111 or the condenser 1112 through the spray port, dust or foreign substances may be removed from the evaporator 1111 or the condenser 1112.

The second hose 1452 and the condensate spray portion 1461 may be provided in plural to spray condensate over a wide region. A fixing pin 1462 is configured to fix the condensate spray portion 1461 to the base cover 1321 or 1322.

The compressor 1120 and a compressor cooling fan 1720 to cool the compressor 1120 may be installed at one side of the water pump 1440. The compressor 1120 is an element constituting the heat pump cycle devices 1100, but does not need to be installed in the air circulation passage because the compressor 1120 does not directly exchange heat with air. When the compressor 1120 is installed in the air circulation passage, it may rather interrupt the flow of the air, thus the compressor 1120 is preferably installed outside the air circulation passage as illustrated in FIG. 3.

The compressor cooling fan 1720 generates wind in a direction toward the compressor 1120 or in a direction sucking air from the compressor 1120. When a temperature of the compressor 1120 is lowered by the compressor cooling fan 1720, compression efficiency is improved.

A gas-liquid separator 1140 is installed at an upstream side of the compressor 1120 based on a flow of the refrigerant. The gas-liquid separator 1140 separates two-phase refrigerant flowing into the compressor 1120 into a gas phase and a liquid phase and allows only the gas phase refrigerant to flow into the compressor 1120. This is because the liquid phase refrigerant causes a malfunction of the compressor 1120 and a decrease of efficiency.

The refrigerant evaporates (liquid->gas) while absorbing heat from the evaporator 1111, becomes a low-temperature and low-pressure gas state, and is sucked into the compressor 1120. When the gas-liquid separator 1140 is installed at the upstream side of the compressor 1120, refrigerant may pass through the gas-liquid separator 1140 before flowing into the compressor 1120. In the compressor 1120, the refrigerant in the gas phase is compressed and becomes a high-temperature and high-pressure state, and flows to the condenser 1112. In the condenser 1112, the refrigerant is liquefied while releasing heat. Liquefied high-pressure refrigerant is decompressed in an expander (not illustrated).

Low-temperature and low-pressure liquid refrigerant is introduced into the evaporator 1111.

Hot and dry air is supplied to the drum 1030 through the inlet duct 1210 to dry the object for treating. The hot and dry air evaporates moisture from the object for treating and becomes hot and humid air. The hot and humid air is recovered through the outlet duct 1220 and receives heat from the refrigerant through the evaporator 1111 to become low temperature air. As the temperature of the air is lowered, a saturation amount of water vapor in the air decreases, and the vapor contained in the air is condensed. Subsequently, the low-temperature dry air receives heat from the refrigerant through the evaporator 1111, becomes high-temperature dry air, and is again supplied to the drum 1030.

The drum motor 1800 is disposed at a front side of the compressor 1120. The drum motor 1800 has an output shaft protruding in both directions. In this specification, a part of the output shaft protruding to one side of the drum motor 1800 is referred to as a first output shaft, and another part of the output shaft protruding to another side of the drum motor 1800 is referred to as a second output shaft. However, since the first output shaft and the second output shaft are one rotating shaft, they are rotated in a same direction and at a same speed.

The first output shaft and the second output shaft are exposed in opposite directions. It can be seen that the first output shaft is disposed to face the rear side of the clothes treating apparatus 1000, and the second output shaft is disposed to face the front side of the clothes treating apparatus 1000.

A pulley 1810 is installed to be rotated by the first output shaft. When the drum motor 1800 is operated, then the first output shaft is rotated sequentially, the pulley 1810 is also rotated together with the first output shaft in a rotation direction opposite to that of the first output shaft. For example, the pulley 1810 may be rotated in engagement with the first output shaft.

A belt (not illustrated) is coupled to the pulley 1810, and a driving force of the drum motor 1800 is transmitted to the drum 1030 through the belt. The drum 1030 is rotated by the driving force of the drum motor 1800 transmitted through the pulley 1810 and the belt. A rotation speed of the drum 1030 is adjusted by the pulley 1810. Since the belt is not directly connected to a first rotating shaft, the rotation speed of the drum 1030 does not necessarily match a rotation speed of the first output shaft.

The blower 1820 is installed at the second output shaft. The blower 1820 includes the axial fan that generates wind in a direction from the rear side of the clothes treating apparatus 1000 toward the front side of the clothes treating apparatus 1000.

The blower 1820 generates wind in a direction in which air is sucked from the drum motor 1800. The drum motor 1800 may be cooled by the blower 1820. Since the blower 1820 is directly connected to the second output shaft, a rotation speed of the blower 1820 matches a rotation speed of the second output shaft.

A sealing of the drum 1030 may not be perfect, but when the blower 1820 rotates, it is possible to suppress an occurrence of condensation due to incomplete sealing of the drum 1030. For example, it is difficult to completely exclude that hot and humid air is discharged into a space between an inner circumferential surface of the drum 1030 and the inner circumferential surface of the cabinet 1010. In particular, when an air leaked from the drum 1030 becomes stagnant, this causes condensation.

However, since the blower 1820 causes convection, stagnation of the air leaked from the drum 1030 is suppressed, and an occurrence of condensation is suppressed. The air leaked from the drum 1030 is exhausted while continuously flowing by the blower 1820.

When two output shafts are provided in one drum motor 1800, there are many advantages in terms of improving power consumption of the clothes treating apparatus 1000. Basically, compared to a case where a motor to rotate the drum 1030 and a motor to rotate the blower 1820 are respectively provided, power consumption is reduced by hal.

Particularly, a time point at which the blower 1820 needs to rotate is same as a time point at which the drum 1030 rotates. This is because hot and dry air is supplied to the drum 1030 while the drum 1030 rotates, and hot and humid air may leak from the drum 1030. Therefore, a situation in which power is unnecessarily consumed to rotate only the blower 1820 in a state where the rotation of the drum 1030 is unnecessary does not occur.

A rear cover 1014 is disposed at a rearmost side of the clothes treating apparatus 1000 and defines a rear appearance of the clothes treating apparatus 1000. In this sense, the rear cover 1014 corresponds to a rear wall of the clothes treating apparatus 1000 or a rear wall of the cabinet 1010. Meanwhile, a front surface portion of the cabinet 1010 located at an opposite side of the rear cover 1014 may be referred to as a front cover.

The rear cover 1014 includes a rear cover base portion 1014*a*, a rear protrusion 1014*b*, a connection portion 1014*c*, ventilation holes 1014*d*, an exhaust port 1014*e*, a bracket 1014*f*, a water container insertion opening 1014*g*, and a protective cover coupling portion 1014*h*. Hereinafter, these structures will be described in order.

A rear base portion 1051 has a flat plate shape. The rear protrusion 1014*b* protrudes from the rear cover base portion 1014*a* toward the rear side of the clothes treating apparatus 1000. The rear protrusion 1014*b* is formed at a position facing the inlet duct 1210 to secure an area to install the inlet duct 1210.

The connection portion 1014*c* extends from an edge of the rear protrusion 1014*b* toward the rear cover base portion 1014*a*, and connects the edge of the rear protrusion 1014*b* and the rear cover base portion 1014*a*.

A plurality of ventilation holes 1014*d* may be formed at one region of the rear protrusion 1014*b*. The plurality of ventilation holes 1014*d* may be formed at a position facing the inlet duct 1210. The plurality of ventilation holes 1014*d* may have a shape opened toward an inclined direction. The plurality of ventilation holes 1014*d* induces passive entry and exit of air into and from the space between the cabinet 1010 and the drum 1030 to discharge hot and humid air outside the clothes treating apparatus 1000.

The exhaust port 1014*e* and the water container insertion opening 1014*g* are formed at an upper portion of the rear cover base portion 1014*a*. The exhaust port 1014*e* and the water container insertion opening 1014*g* may be formed at sides opposite to each other. For example, referring to the drawings, the exhaust port 1014*e* is formed at the right side, and the water container insertion opening 1014*g* is formed at the left side. A position of the exhaust port 1014*e* and a position of the water container insertion opening 1014*g* may be switched, and in this case, the positions should be switched to positions of the water container 1410, the printed circuit board and others constituting the?? controller 1600.

When the ventilation holes 1014*d* are intended to induce passive entry and exit of air, the exhaust port 1014*e* is related to an exhaust fan 1014*i* (not illustrated) for active discharge of air. For the active discharge of air, the bracket 1014*f* is installed around the exhaust port 1014*e*, and the exhaust fan 1014*i* is installed on the bracket 1014*f*.

The bracket 1014*f* has a shape protruding from a circumference of the exhaust port 1014*e* toward the exhaust port 1014*e*. The bracket 1014*f* may be provided at a left side and a right side of the exhaust port 1014*e*, respectively.

The exhaust fan 1014*i* is mounted on the bracket 1014*f*, and is arranged to face the exhaust port 1014*e*. Accordingly, a position of the exhaust fan 1014*i* is determined according to a position of the exhaust port 1014*e*, and the exhaust fan 1014*i* may be disposed at an upper left side or an upper right side of the drum 1030. It may be understood that the rear cover base portion 1014*a* corresponds to an inner rear wall of the cabinet 1010, and the exhaust fan 1014*i* is mounted to the inner rear wall of the cabinet 1010.

The exhaust fan 1014*i* generates wind to discharge air existing in the space between the cabinet 1010 and the drum 1030 to the outside of the clothes treating apparatus 1000. The space between the cabinet 1010 and the drum 1030 means the second space II between the inner circumferential surface of the cabinet 1010 and the outer circumferential surface of the drum 1030. The exhaust fan 1014*i* may be configured as the axial fan that generates wind in a direction toward the rotating shaft. The exhaust fan 1014*i* generates wind in a direction that blows wind toward the exhaust port 1014*e* (a direction that sucks air present in the space between the cabinet 1010 and the drum 1030 to discharge the air through the exhaust port 1014*e*).

The protective cover coupling portion 1014*h* is provided at a lower portion of the rear base portion 1014*a*. A protective cover 1080 is coupled around the protective cover coupling portion 1014*h*. When maintenance of the compressor 1120 or the drum motor 1800 is needed, an operator can access the compressor 1120 or the drum motor 1800 by simply opening the protective cover 1080 without disassembling the clothes treating apparatus 1000.

It has been previously described that the interior space of the cabinet 1010 is divided into the first space I and the second space II by the drum 1030. The heat pump cycle devices 1100 described above are installed in the second space II. The connecting duct 1230 is installed in the second space II, and the evaporator 1111 and the condenser 1112 among the heat pump cycle devices 1100 corresponding to the heat exchanger 1110 are installed inside the connecting duct 1230. Therefore, the connecting duct 1230 is configured to surround the heat exchanger 1110, and is connected to the drum 1030 to form an air circulation passage between the heat exchanger 1110 and the drum 1030.

The exhaust fan is installed in the second space II. Even in the second space II, the exhaust fan is installed outside of the duct. Here, the outside of the duct means the outside of the connecting duct 1230. In addition to the exhaust fan, it has been previously described that the drum motor 1800 and the blower 1820 are installed outside the connecting duct 1230 in the second space II. That the blower 1820 and the exhaust fan are installed outside the connecting duct 1230 is to suppress condensation by circulating and exhausting wet air leaked from the connecting duct 1230 or the drum 1030 to the second space II.

An air volume and a size of the exhaust fan are closely related to the size of the drum 1030. In particular, it should be considered that one of the important functions of the clothes treating apparatus 1000 is to dry an object for treating such as clothes by using hot air. This is because, when an exhaust effect by the exhaust fan is too strong, a temperature inside the cabinet 1010 decreases, and a drying effect of the clothes treating apparatus 1000 may be deteriorated. Therefore, the air volume and the size of the exhaust fan 1740 should be set in a range capable of suppressing the occurrence of condensation without excessively decreasing the drying effect of the clothes treating apparatus 1000.

Hereinafter, a control configuration of the clothes treating apparatus will be described with reference to FIG. 5A.

Figure 5A:
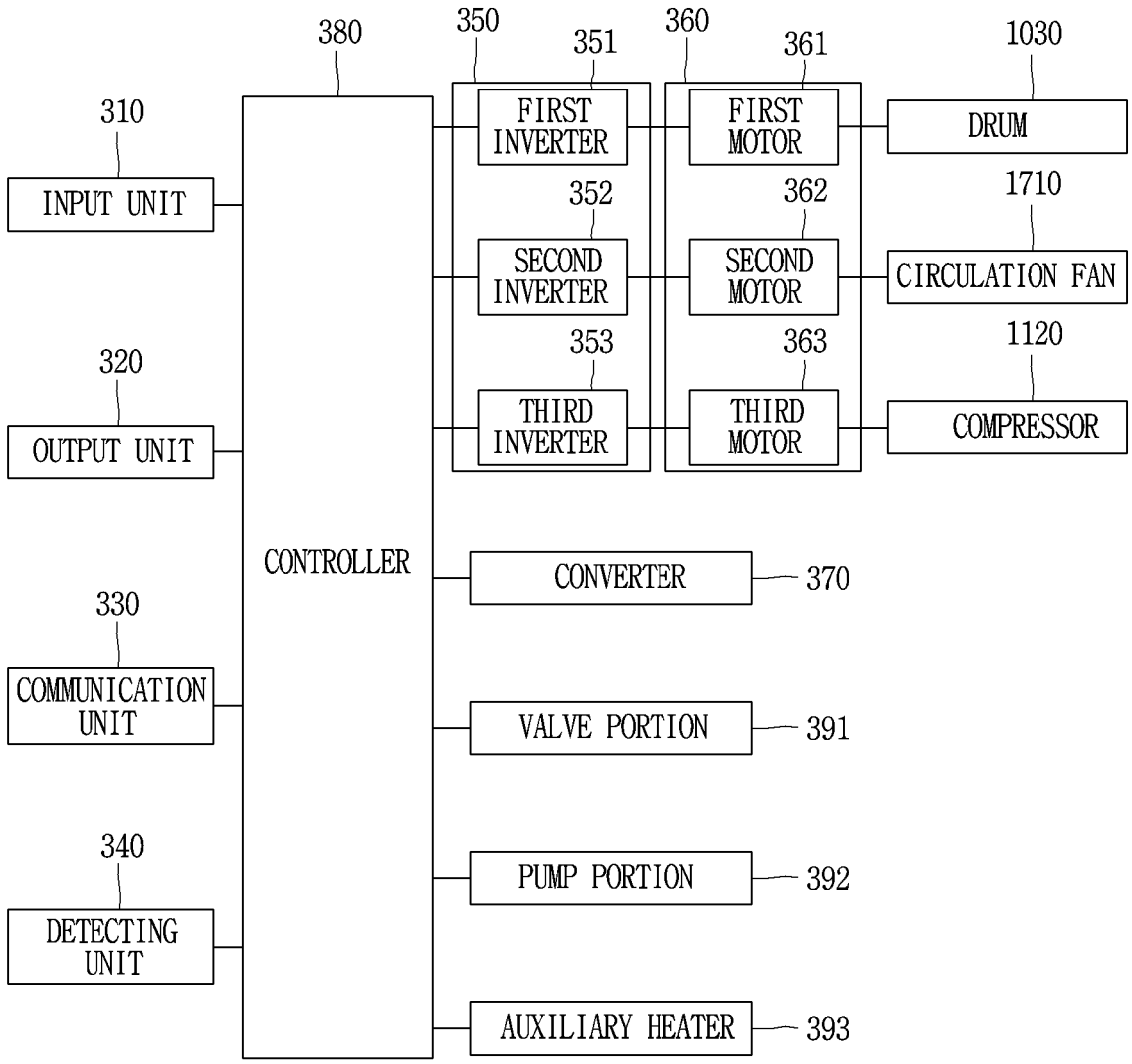
FIG. 5A is a block diagram 1 illustrating an example of a control configuration of a clothes treating apparatus according to an embodiment.

Referring to FIG. 5A, the clothes treating apparatus may include at least one of an input unit 310, an output unit 320, a communication unit 330, a detecting unit 340, an inverter 350, a motor 360, a converter 370, a controller 380, a valve portion 391, a pump portion 392, and an auxiliary heater 393.

The input unit 310 may receive a control command related to the operation of the clothes treating apparatus from a user. The input unit 310 may include a plurality of buttons or a touch screen.

Specifically, the input unit 310 may include a control panel on which an operation mode of the clothes treating apparatus is selected or on which an input related to execution of the selected operation mode is applied.

The output unit 320 may output information related to the operation of the clothes treating apparatus. The output unit 320 may include at least one display.

The information outputted by the output unit 320 may include information related to an operating state of the clothes treating apparatus. That is, the output unit 320 may output information related to at least one of the selected operation modes, whether or not a failure has occurred, an operation completion time, and an amount of clothes accommodated in the drum.

In one example, the output unit 320 may be a touch screen formed integrally with the input unit 310.

The communication unit 330 may perform communication with an external network. The communication unit 330 may receive a control command related to the operation of the clothes treating apparatus from the external network. For example, the communication unit 330 may receive an operation control command of the clothes treating apparatus sent from an external terminal through an external network. Accordingly, a user can remotely control the clothes treating apparatus.

In addition, the communication unit 330 may transmit information related to a result of the operation of the clothes treating apparatus to a predetermined server through the external network.

Also, the communication unit 330 may communicate with other electronic devices in order to establish an Internet of Things (IOT) environment.

The detecting unit 340 may detect information related to the operation of the clothes treating apparatus.

Specifically, the detecting unit 340 may include at least one of a current sensor, a voltage sensor, a vibration sensor, a noise sensor, an ultrasonic sensor, a pressure sensor, an infrared sensor, a visual sensor (camera sensor), and a temperature sensor.

In one example, the current sensor of the detecting unit 340 may sense a current flowing at a point of a control circuit of the clothes treating apparatus.

In another example, the temperature sensor of the detecting unit 340 may sense a temperature inside the drum.

As described above, the detecting unit 340 may include at least one of various types of sensors, and the type of sensors included in the clothes treating apparatus is not limited. In addition, the number or installation position of each sensor may be variously designed according to a purpose.

The inverter 350 may include a plurality of inverter switches, and convert smoothed DC power Vdc into three-phase AC power va, vb, and vc having a predetermined frequency by an on/off operation of the switches so as to output the three-phase AC power va, vb, and vc to the motor.

Referring to FIG. 5A, the clothes treating apparatus may include a plurality of inverters 351, 352, and 353, and each inverter may supply power to a plurality of motors 361, 362, and 363.

In FIG. 5A, the clothes treating apparatus has three inverters 351, 352, and 353, and each inverter supplies power to three motors 361, 362, and 363, but the number of inverters and the number of motors are not limited thereto.

Specifically, a first inverter 351 may supply power to a first motor 361 that rotates the drum 1030, and a second inverter 352 may rotate a second motor 362 that rotates the circulation fan 1710, and a third inverter 353 may supply power to a third motor 363 operating the compressor 1120 of the heat pump.

A rotating shaft of the first motor 361 and a rotating shaft of the drum 1030 are connected by a belt (not illustrated), and the first motor 361 may transmit rotational force to the drum 1030 side through the belt.

The motor 360 may be a BLDC motor capable of controlling speed based on a speed command value, or may be a constant speed motor that does not perform speed control. In one example, the first motor to rotate the drum and the third motor to operate the compressor may be configured as the BLDC motor, and the second motor to rotate the blower may be configured as the constant speed motor.

Each of the inverters 351, 352, and 353 has upper-arm switches Sa, Sb, and Sc and lower-arm switches S'a, S'b, and S'c which are connected in series as pairs, respectively, and thus three pairs of upper and lower-arm switches Sa & S'a, Sb & S'b, and Sc & S'c in total are connected in parallel. Diodes are connected in anti-parallel to the switches Sa, S'a, Sb, S'b, Sc, and S'c, respectively.

That is, a first upper-arm switch Sa and a first lower-arm switch S'a may implement a first phase, a second upper-arm switch Sb and a second lower-arm switch S'b may implement a second phase, and a third upper-arm switch Sc and a third lower-arm switch S'c may implement a third phase.

In one example, the inverter 350 may include a shunt resistor corresponding to at least one of the first to third phases.

Specifically, a first shunt resistor may be connected to one end of the first lower-arm switch S'a in the first switch pair Sa and S'a, and similarly, a second shunt resistor may be connected to one end of the second lower-arm switch S'b, and a third shunt resistor may be connected to one end of the third lower-arm switch S'c. The first to third shunt resistors are not essential components, and if necessary, only some of the three shunt resistors can be installed.

In another example, the inverter 350 may be connected to a common shunt resistor commonly connected to the first to third phases.

Meanwhile, the switches in the inverters 351, 352, and 353 operate on/off of each switch based on an inverter switching control signal generated by the controller 380. Accordingly, the three-phase AC power having a predetermined frequency is output to the motor 360.

The inverters 351, 352, and 353 performing the above-described functions may include intelligent power modules (IPM) in which each of the switches Sa, S'a, Sb, S'b, Sc, and S'c is formed in a single module.

The controller 380 may control switching operation of the inverter 351, 352, and 353 in a sensorless type. Specifically, the controller 380 may control the switching operation of the inverter 350 by using a phase current on the motor detected by the current sensor of the detecting unit 340.

The controller 380 outputs the inverter switching control signal to the inverters 351, 352, and 353 in order to control the switching operation of the inverters 351, 352, and 353. Here, the inverter switching control signal includes a pulse width modulation (PWM) type switching control signal.

As illustrated in FIG. 5A, the clothes treating apparatus includes a plurality of inverters. Since the power consumption may increase as the number of inverters increases, this specification proposes a clothes treating apparatus having a converter 370.

The converter 370 converts commercial AC power into DC power and outputs the converted DC power. In more detail, the converter 370 may convert single-phase AC power or three-phase AC power into DC power and outputs the converted DC power. An internal structure of the converter 370 also varies depending on a type of the commercial AC power.

Meanwhile, the converter 370 may be configured with a diode or the like without a switching element, and may perform a rectifying operation without a separate switching operation.

For example, in a case of a single-phase AC power source, four diodes may be used in a form of a bridge. In a case of a three-phase AC power source, six diodes may be used in a form of a bridge.

The converter 370, for example, may be a half-bridge type converter in which two switches and four diodes are connected. In a case of a three-phase AC power source, six switches and six diodes may be used.

When the converter 370 includes a switching element, the converter 410 may perform a boosting operation, a power factor correction, and a DC power conversion by a switching operation of the switching element.

The valve portion 391 is disposed at one point of the flow path installed in the clothes treating apparatus, and may regulate a flow of the flow path. The pump portion 392 may provide a driving force to supply gas or liquid to the flow path.

In addition, the auxiliary heater 393 is installed separately from the heat pump, and may supply heat to the drum. The auxiliary heater 393 may heat the air flowing into the drum.

The controller 380 may control components included in the clothes treating apparatus.

First, the controller 380 may generate at least one of a power command value, a current command value, a voltage command value, and a speed command value corresponding to the motor in order to control rotation of the motor 360.

Specifically, the controller 380 may calculate the power or load of the motor 360 based on the output of the detecting unit 340. Specifically, the controller 380 may calculate a rotation speed of the motor by using a phase current value sensed by the current sensor of the detecting unit 340.

In addition, the controller 380 may generate a power command value corresponding to the motor, and calculate a difference between the generated power command value and the calculated power. In addition, the controller 380 may generate a speed command value of the motor based on the difference between the power command value and the calculated power.

Furthermore, the controller 380 may calculate a difference between the speed command value of the motor and the calculated rotation speed of the motor. In this case, the controller 380 may generate a current command value to be applied to the motor based on the difference between the speed command value and the calculated rotation speed.

In one example, the controller 380 may generate at least one of a q-axis current command value and a d-axis current command value.

Meanwhile, the controller 380 may convert a phase current of a stationary coordinate system or a phase current of a rotating coordinate system based on the phase current detected by the current sensor. The controller 380 may generate a voltage command value applied to the motor by using the converted phase current and the current command value.

By performing this process, the controller 380 generates the inverter switching control signal according to the PWM type.

The controller 380 may adjust a duty ratio of the switch included in the inverter by using the inverter switching control signal.

Also, the controller 380 may control an operation of at least one of the drum, the blower, and the heat pump based on the control command input by the input unit 310.

In one example, the controller 380 may control a rotation pattern of the drum based on the user input applied to the input unit 310.

In another example, the controller 380 may control the rotation speed or operation time of the blower based on the user input applied to the input unit 310.

In another example, the controller 380 may control an output of the heat pump to adjust the temperature in the drum based on the user input applied to the input unit 310.

Figure 5B:
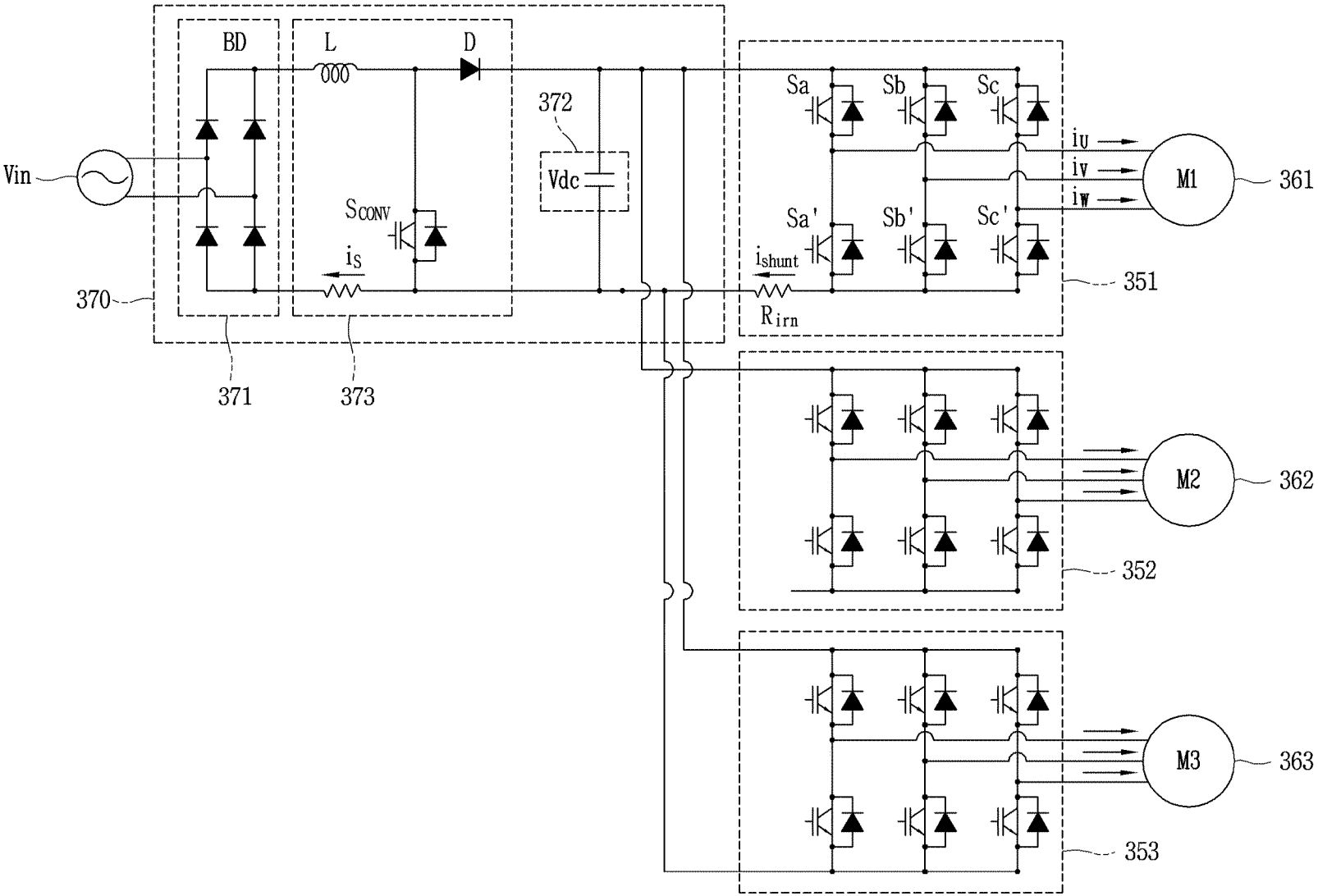
FIG. 5B is a circuit diagram 1 illustrating control circuits of a clothes treating apparatus according to an embodiment.

In FIG. 5B, the control circuit of the clothes treating apparatus according to an embodiment is described.

The control circuit included in the clothes treating apparatus according to the present disclosure may further include the converter 370, a DC-link voltage detector B, a smoothing capacitor Vdc, a plurality of shunt resistors, a plurality of inverters 351, 352, and 353, a plurality of diodes D and BD, a reactor L, and others.

The reactor L is disposed between a commercial AC power source Vin and the converter 370 to perform a power factor correcting or boosting operation. In addition, the reactor L may also perform a function of limiting a harmonic current caused by fast switching of the converter 370.

The converter 370 converts the commercial AC power source Vin, which has passed through the reactor L, into DC power and outputs the DC power. Although the commercial AC power source Vin is illustrated as a single-phase AC power source in the drawing, the commercial AC power source Vin may be a three-phase AC power source.

The smoothing capacitor Vdc smooths input power and stores the smoothed input power. In the drawing, one element is illustrated as the smoothing capacitor Vdc, but a plurality of elements may alternatively be provided to ensure element stability. Both ends of the smoothing capacitor Vdc may be referred to as a DC-link or a DC-link end since DC power is stored at the both ends of the smoothing capacitor Vdc.

The controller 380 may detect an input current is that is inputted from the commercial AC power source Vin by using the shunt resistor installed in the converter 370.

In addition, the controller 380 may detect a phase current of the motor by using the shunt resistor Rin installed in the inverter 350.

[Apparatus for Controlling Clothes Treating Apparatus]

Hereinafter, an embodiment of an apparatus for controlling a clothes treating apparatus will be described, but descriptions repeating the above-mentioned contents may be omitted, and a specific embodiment of the apparatus for controlling the clothes treating apparatus will be mainly described.

Figure 6A:
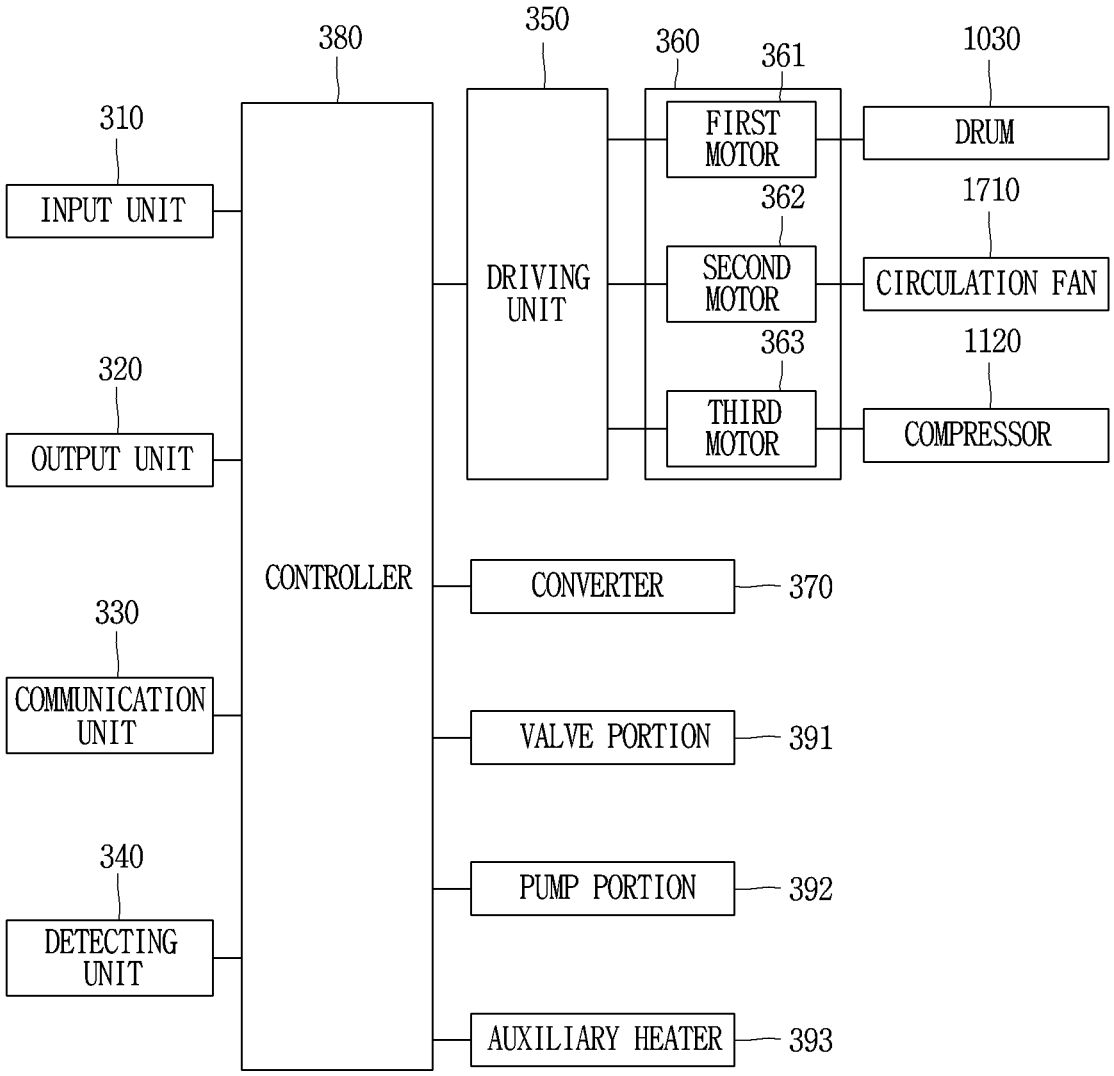
FIG. 6A is a block diagram 2 illustrating an example of a control configuration of a clothes treating apparatus according to an embodiment.

The apparatus for controlling the clothes treating apparatus (hereinafter referred to as a control apparatus) is a control apparatus of the clothes treating apparatus 1000 as illustrated in FIG. 5A or 6A, it may be the controller 1600 previously described in the basic configuration of the clothes treating apparatus 1000.

The control apparatus 1600 may be configured as a module on one circuit board.

Figure 6B:
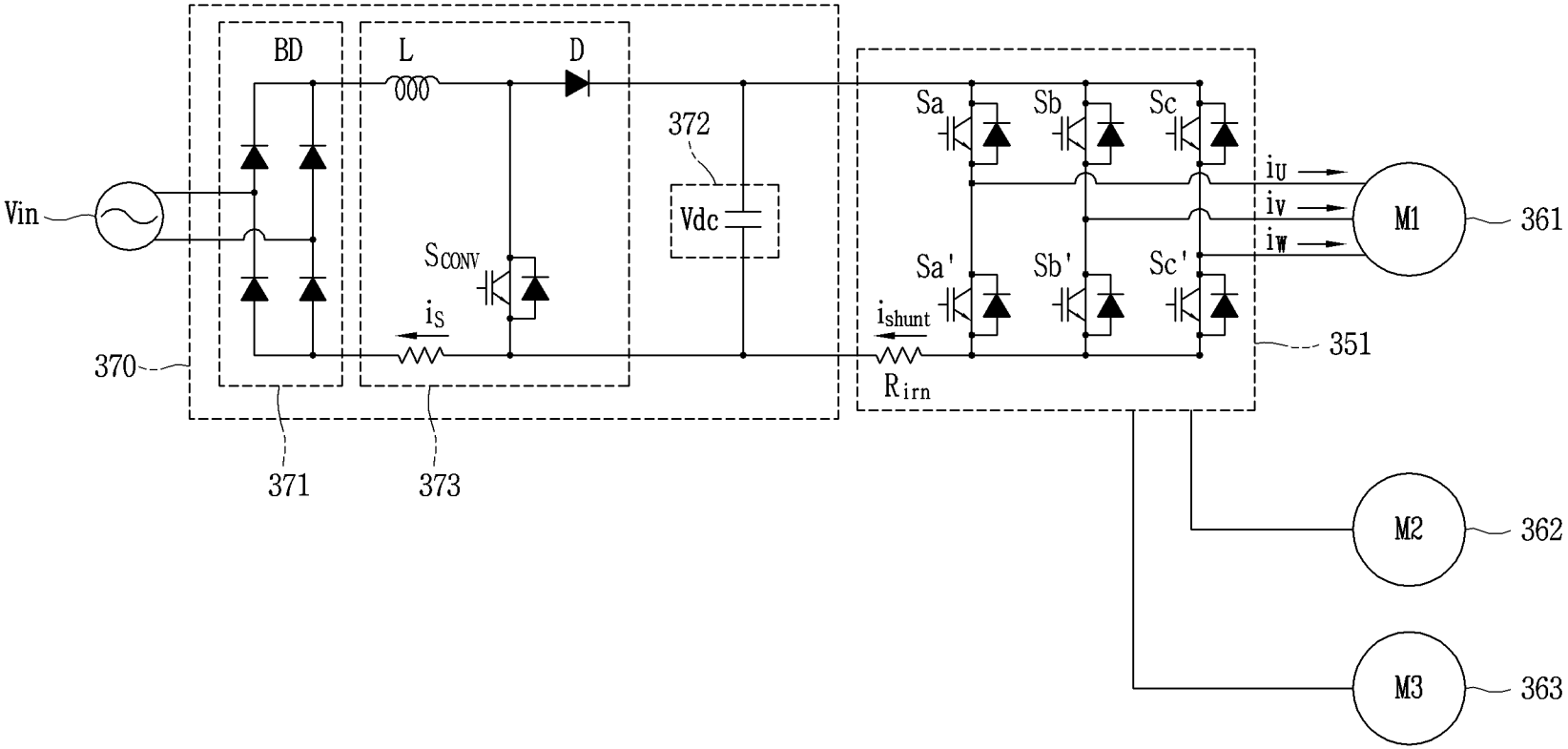
FIG. 6B is a circuit diagram 2 illustrating control circuits of a clothes treating apparatus according to an embodiment.

A specific circuit configuration of the control apparatus 1600 configured as a module on one circuit board may be as illustrated in FIG. 5B or 6B.

Figure 7:
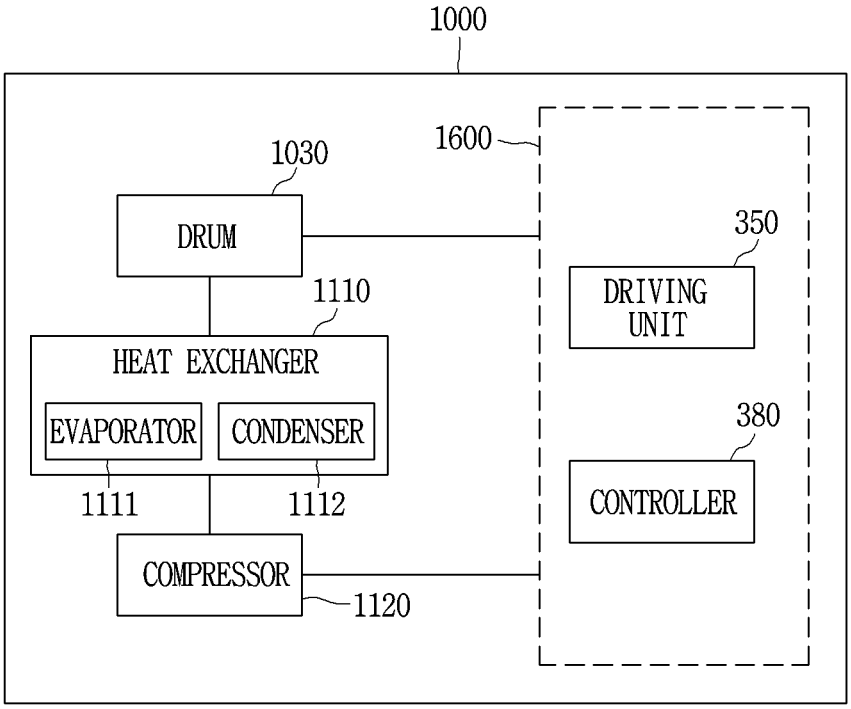
FIG. 7 is a block diagram illustrating a configuration according to an embodiment of an apparatus for controlling a clothes treating apparatus.

The control apparatus 1600 is, as illustrated in FIG. 7, a control apparatus of a clothes treating apparatus configured to control the clothes treating apparatus 1000 including a drum 1030 rotatably installed inside a main body (cabinet) 1010 that defines an exterior, and into and from which an air to dry an object flows in and out; a heat exchanger 1110 provided at an air circulation passage connected to the drum 1030 and including an evaporator 1111 and a condenser 1112 that exchange heat with an air circulating in the air circulation passage; and a compressor 1120 configured to compress a refrigerant, and the control apparatus 1600 is included in the clothes treating apparatus 1000 to control the clothes treating apparatus 1000.

The control apparatus 1600 may control a plurality of components included in the clothes treating apparatus 1000 so that the operation of the clothes treating apparatus 1000 is performed.

For example, the control apparatus 1600 may control the operations of the drum 1030 and the compressor 1120 so that a drying operation of the clothes treating apparatus 1000 is performed.

In addition, the control apparatus 1600 may control an overall function performance of the internal components to perform the operation of the clothes treating apparatus 1000.

For example, the control apparatus 1600 may control the operation of the clothes treating apparatus 1000 by controlling an operation of the compressor 1120 to compress the refrigerant circulating through the heat exchanger 1110 and exchanging heat with the air circulating in the air circulation passage.

In this way, the control apparatus 1600 to control the clothes treating apparatus 1000 includes a driving unit 350 configured to drive the compressor 1120, and the controller 380 configured to control the driving unit 350 to control the operation of the compressor 1120.

The control apparatus 1600 may further include a detecting unit 340 that senses a temperature of the heat exchanger 1110.

In this case, the controller 380 may control the driving unit 350 so that the refrigerant is compressed and circulated according to the detection result of the detecting unit 340, and thus to control the operation of the compressor 1120.

The detecting unit 340 refers to a sensing means to sense the temperature of the heat exchanger 1110 in the air circulation passage.

The detecting unit 340 may include one or more temperature sensors that sense the temperature of the heat exchanger 1110 in the air circulation passage to transmit the sensed result to the controller 380.

The detecting unit 340 may include one or more temperature sensors to sense at least one of a temperature of air and a temperature of refrigerant respectively circulating in the evaporator 1111 and the condenser 1112.

For example, the detecting unit 340 may include a first sensor to sense the temperature of the air circulating in the evaporator 1111 and a second sensor to sense the temperature of the refrigerant circulating in the condenser 1112.

The detecting unit 340 may further include a plurality of temperature sensors to sense the temperature of the air flowing into and out of the drum 1030.

As described above, the detecting unit 340 including the plurality of temperature sensors may be configured such that a sensing module sensing a temperature is provided in the air circulation passage, such as the heat exchanger 1110, and a sensing module to sense the temperature by receiving the sensed result of the plurality of temperature sensors to sense the temperature is provided in the control apparatus 1600.

The driving unit 350 may refer to an inverter that applies driving power to the motor.

The driving unit 350 may include at least one inverter.

The driving unit 350 may drive the compressor 1120 by applying driving power to a motor of the compressor 1120 through one or more inverters.

The driving unit 350 may also drive the drum 1030 and the circulation fan 1710.

The driving unit 350 may drive the compressor 1120 by a control of the controller 380.

The driving unit 350, including the first to third inverters 351 to 353 as illustrated in FIG. 5A, may drive each of the drum 1030, the circulation fan 1710, and the compressor 1120 by applying driving power to each of the first motor 361 configured to drive the drum 1030, the second motor 362 configured to the circulation fan 1710, and the third motor 363 configured to drive the compressor 1120.

The driving unit 350 may also drive each of the drum 1030, the circulation fan 1710, and the compressor 1120 by applying driving power to each of the first to third motors 361 to 363 with one inverter, as illustrated in FIG. 6A.

Hereinafter, for convenience of explanation, the driving unit 350 will be described based on an embodiment including the first to third inverters 351 to 353 as illustrated in FIG. 5A.

The controller 380 may control operations of at least one of the drum 1030, the circulation fan 1710, and the compressor 1120 by driving the plurality of motors 360 included in the clothes treating apparatus 1000.

The controller 380, as illustrated in FIG. 5B, may control the converter 370 that converts and smooths AC power inputted from an external power included in the control apparatus 1600 into a DC power, and control the driving unit 350 that converts the DC power smoothed in the converter 370 into a driving power to drive the plurality of motors 360 configured to drive the clothes treating apparatus 100 to output the converted driving power to each of the plurality of motors 360, thereby driving the plurality of motors 360.

Here, the driving unit 350 may include the plurality of inverters 351 to 353.

That is, the controller 380 may control the operation of the clothes treating apparatus 1000 by controlling the converter 370 and the plurality of inverters 350 to control the operation of the plurality of motors 360.

More specifically, the clothes treating apparatus 1000, which is a control target of the control apparatus 1600, includes the drum 1030 configured to accommodate an object for drying to perform the drying operation, the circulation fan 1710 promoting a flow of air inside the clothes treating apparatus, the compressor 1120 of the heat pump that removes moisture from the air flew out from the drum 1030 and exchanges heat, the plurality of motors 360 that drives each of the drum 1030, the circulation fan 1710, and the compressor 1120. The control apparatus 1600 includes the first inverter 351 configured to drive the first motor 361 to drive the drum 1030 in the plurality of motors 360, the second inverter 352 configured to drive the second motor 362 to drive the circulation fan 1710, and the third inverter 353 configured to drive the third motor 363 to drive the compressor 1120. The controller 380 may control the operation of the clothes treating apparatus 1000 by controlling each of the plurality of inverters 350 to control the operation of the plurality of motors 360.

The controller 380 may control the operation of the clothes treating apparatus 1000 of the object for drying by controlling the plurality of inverters 350 to control the operation of the plurality of motors 360.

For example, the controller 380 may control the drying operation on the object for drying or the sterilizing operation to sterilize the evaporator 1111.

Here, the drying operation and the sterilizing operation may be set to an operation mode of the clothes treating apparatus 1000, and the controller 380 may control the operation of the clothes treating apparatus 1000 according to the set operation mode.

For example, when the clothes treating apparatus 1000 is set to a sterilization mode to perform the sterilizing operation, the controller 380 may control the clothes treating apparatus 1000 to perform an operation according to the sterilization mode.

Figure 8:
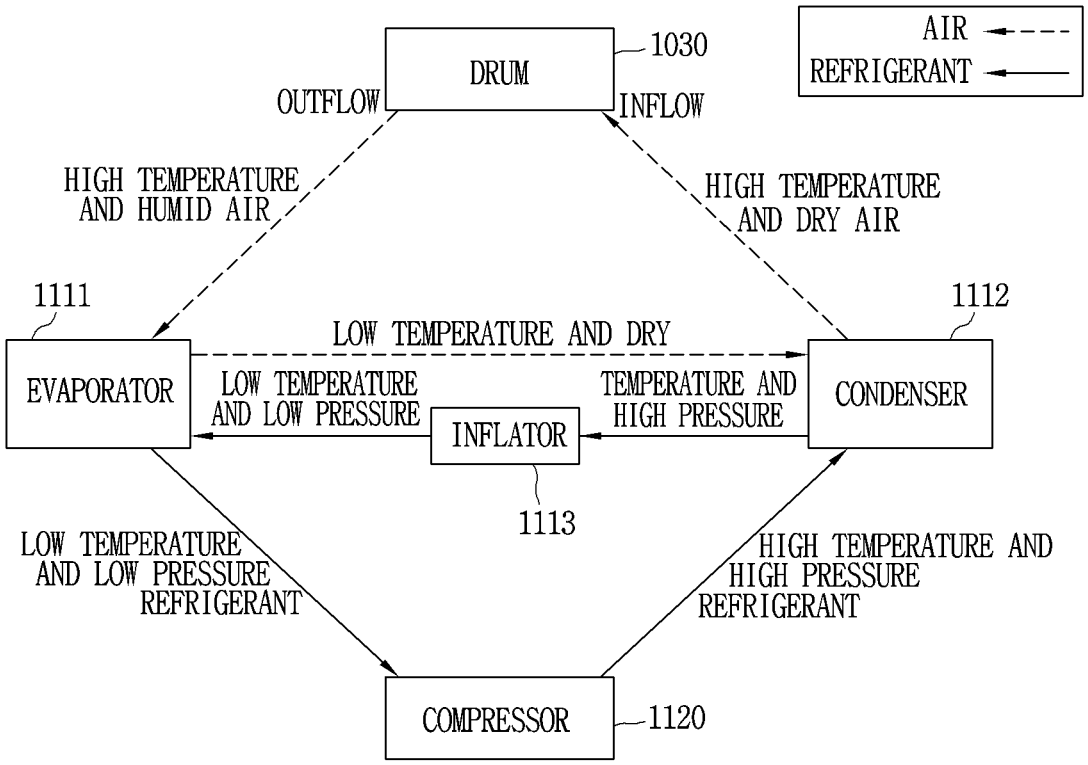
FIG. 8 is a conceptual view illustrating a concept of a heat pump cycle according to an embodiment.

When controlling the drying operation, the controller 380 may control the operation of the compressor 1120 so as to configure a heat pump cycle as illustrated in FIG. 8.

When the controller 380 controls the drying operation, the controller 380 controls the operation of the compressor 1120 to allow air and refrigerant to circulate as illustrated in FIG. 8, so that the drying operation is performed.

More specifically, the circulation process of the refrigerant in which the heat pump cycle is performed is configured such that, when the controller 380 drives the compressor 1120 to perform the drying operation, the refrigerant is compressed in a high-temperature and high-pressure state in the compressor 1120, then discharged to be transmitted to the condenser 1112. The refrigerant transmitted to the condenser 1112 may exchange heat with the low-temperature dry air passing through the condenser 1112 to be transmitted to the expander 1113 in a state of low-temperature and high-pressure. The low-temperature and high-pressure refrigerant transmitted to the expander 1113 may become a low-temperature and low-pressure state by the expander 1113 to be transmitted to the evaporator 1111. The refrigerant transmitted to the evaporator 1111 may exchange heat with hot and humid air passing through the evaporator 1111 to be sucked into the compressor 1120 in a low-temperature and low-pressure state. The refrigerant sucked into the compressor 1120 may be compressed again in a high-temperature and high-pressure state, then transmitted to the condenser 1112.

Meanwhile, the process of circulating air is configured such that, the air that has exchanged heat with a high-temperature and high-pressure refrigerant in the condenser 1112 is introduced into the drum 1030 through the air circulation passage, then dries the object for drying accommodated in the drum 1030. The air that became hot and humid after being introduced into the drum 1030 to dry the object for drying may be discharged from the drum 1030 and then to the evaporator 1111 through the air circulation passage. The hot and humid air discharged from the drum 1030 to the evaporator 1111 becomes a low-temperature and dry air after exchanging heat with a low-temperature and low-pressure refrigerant in the evaporator 1111, then may be transmitted to the condenser 1112 through the air circulation passage. The air transmitted to the condenser 1112 becomes a high-temperature and dry air after exchanging heat with a high-temperature and high-pressure refrigerant circulating in the condenser 1112, then may be transmitted to the drum 1030.

As described above, the drying operation may be performed as air and refrigerant are exchanging heat while being circulated by the driving of the compressor 1120.

Figure 9:
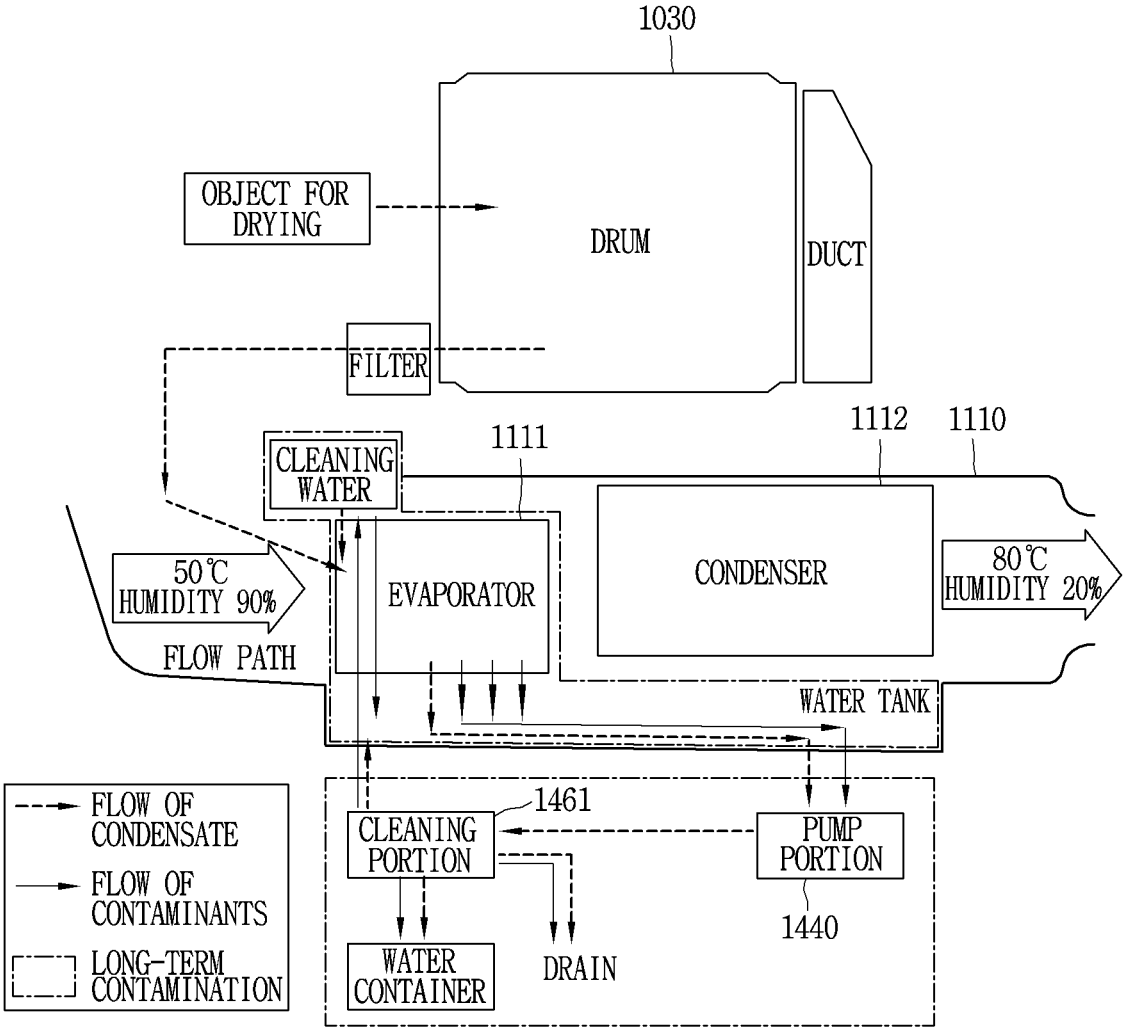
FIG. 9 is a conceptual view explaining a cause of contamination of a clothes treating apparatus according to an embodiment.

Meanwhile, when the drying operation is performed as described above, condensate is generated in the evaporator 1111 as a humidity of air that has dried the object while passing through the drum 1030 decreases as illustrated in FIG. 9. And, since the condensate may include contaminants or bacteria contained in the drum 1030 and the object for drying, the condensate may contaminate at least one of the evaporator 1111, the water container 1410, a cleaning portion 1601, and a pump portion 1440 through which condensate passes.

The sterilizing operation is an operation to sterilize the evaporator 1111 that is contaminated during the drying operation. And the controller 380, when the sterilizing operation is performed in the clothes treating apparatus 1000, may control the sterilizing operation so that the evaporator 1111 contaminated by the drying operation is sterilized.

That is, the control apparatus 1600 may control the clothes treating apparatus 1000 so that the sterilizing operation is performed on the evaporator 1111.

In the control apparatus 1600, the controller 380 controls the driving of the compressor 1120 so that a surface temperature of the evaporator 1111 is equal to or higher than a predetermined reference temperature.

That is, the controller 380 may control the driving of the compressor 1120 so that the surface temperature is equal to or higher than the reference temperature.

The controller 380 may control the operation of the compressor 1120 so that the surface temperature is at or above the reference temperature to allow the sterilizing operation.

That is, when controlling the sterilizing operation on the evaporator 1111, the controller 380 may control the driving of the compressor 1120 so that the surface temperature is equal to or higher than the reference temperature.

In this way, when the sterilizing operation is performed on the evaporator 1111, the compressor controls the driving of the compressor 1120 to allow the surface temperature to stay at or above the reference temperature so that the evaporator 1111 is sterilized at or above the reference temperature.

That is, the sterilizing operation may be a mode to allow the surface temperature to be at or above the reference temperature, and when the clothes treating apparatus 1000 performs the sterilizing operation, the surface temperature stays at or above the reference temperature by the driving of the compressor 1120 to sterilize the evaporator 1111.

The controller 380 may control the driving of the compressor 1120 such that the surface temperature is equal to or higher than the reference temperature in a no-load state.

That is, the controller 380 may control the driving of the compressor 1120 such that the surface temperature is equal to or higher than the reference temperature in the no-load state.

The controller 380 may control the sterilizing operation to be performed in a state in which the object for drying is not accommodated in the drum 1030.

When the sterilizing operation is performed on the evaporator 1111, the controller 380 may control the sterilizing operation to be performed in the no-load state in which the object for drying is not received in the drum 1030.

That is, the sterilizing operation may be performed in the no-load state in which the object for drying is not accommodated in the drum 1030.

Accordingly, the sterilizing operation is an operation performed in the no-load state in which the object for drying is not accommodated in the drum 1030, and may be performed separately from the drying operation for drying the object.

In addition, the sterilizing operation may be performed alone as an operation mode separate from the drying operation performed in the clothes treating apparatus 1000.

For example, when the sterilization mode is added to the clothes treating apparatus 1000 as an additional function and the sterilization mode is selected or set by a user of the clothes treating apparatus 1000, the sterilizing operation may be performed alone.

In this way, the controller 380 may control the driving of the compressor 1120 so that the surface temperature is equal to or higher than the reference temperature in the no-load state to perform the sterilizing operation in which the evaporator 1111 is sterilized at or above the reference temperature.

When the controller 380 controls the operation of the compressor 1120 so that the surface temperature stays at or above the reference temperature, the controller 380 may drive the compressor 1120, then stop the operation of the compressor 1120 at a predetermined specific time point.

That is, the controller 380 may control the surface temperature to be at or above the reference temperature by stopping the operation of the compressor 1120 when the compressor 1120 reaches the specific time point after being driven.

Here, the specific time point may be a time point for at least one of a driving time and a driving condition of the compressor 1120.

For example, it may be a time point for a stable section of the heat pump cycle due to driving of the compressor 1120.

According to this, when the heat pump cycle enters the stable section after the controller 380 drives the compressor 1120, the controller 380 may stop the operation of the compressor 1120 so that the surface temperature is equal to or higher than the reference temperature.

When the operation of the compressor 1120 is controlled such that the surface temperature is equal to or higher than the reference temperature, the controller 380 may stop the operation of the compressor 1120 when a temperature change of the heat exchanger 1110 or an operating state of the compressor 1120, or both, meet a predetermined reference condition.

The controller 380, after driving the compressor 1120, may determine the temperature change of the heat exchanger 1110 and the operating state of the compressor 1120 to stop the operation of the compressor 1120 when at least one of the temperature change of the heat exchanger 1110 and the operating state of the compressor 1120 corresponds to the reference condition.

That is, after driving the compressor 1120, the controller 380 may stop the operation of the compressor 1120 so that the surface temperature stays at or above the reference temperature, when at least one of the temperature change of the heat exchanger 1110 and the operating state of the compressor 1120 corresponds to the reference condition as a result of monitoring by determining the temperature change of the heat exchanger 1110 and the operating state of the compressor 1120.

The controller 380 may determine the temperature change of the heat exchanger 1110 through the detection result of the detecting unit 340, and determine the operating state of the compressor based on driving control information on the compressor 1120.

The temperature change of the heat exchanger 1110 may include at least one of the temperature changes in the air circulating in the evaporator 1111, the refrigerant circulating in the evaporator 1111, the air circulating in the condenser 1112, and the refrigerant circulating in the condenser 1112.

For example, the temperature change of the heat exchanger 1110 may include one of the temperature changes in the air introduced into the evaporator 1111, the air discharged from the evaporator 1111, the refrigerant introduced into the evaporator 1111, the refrigerant discharged from the evaporator 1111, the air introduced into the condenser 1112, the air discharged from the condenser 1112, the refrigerant introduced into the condenser 1112, and the refrigerant discharged from the condenser 1112.

Accordingly, the controller 380 may determine each of the temperature changes in the air introduced into the evaporator 1111, the air discharged from the evaporator 1111, the refrigerant introduced into the evaporator 1111, the refrigerant discharged from the evaporator 1111, the air introduced into the condenser 1112, the air discharged from the condenser 1112, the refrigerant introduced into the condenser 1112, and the refrigerant discharged from the condenser 1112, through the detection result of the detecting unit 340.

The operating state of the compressor 1120 may include at least one of an operating time of the compressor 1120, an operating section of the compressor 1120, and an operating frequency of the compressor 1120.

Accordingly, the controller 380 may determine each of the operating states of the operating time of the compressor 1120, the operating section of the compressor 1120, and the operating frequency of the compressor 1120, based on the driving control information.

The reference condition may be a condition for stopping the compressor 1120 corresponding to each of the temperature change and the operating state.

The reference condition may be a condition for a stable section of the heat pump cycle.

The reference condition may include at least one of the conditions for stopping the operation of the compressor 1120 corresponding to each of the temperature change and the operating state.

The reference condition may include conditions for each of the temperature change of the heat exchanger 1110 for a predetermined time, the operating time of the compressor 1120, the operating section of the compressor 1120, and the operating frequency of the compressor 1120.

For example, the reference condition may include conditions (#1 to #8) for each of the temperature changes in the air introduced into the evaporator 1111, the air discharged from the evaporator 1111, the refrigerant introduced into the evaporator 1111, the refrigerant discharged from the evaporator 1111, the air introduced into the condenser 1112, the air discharged from the condenser 1112, the refrigerant introduced into the condenser 1112, and the refrigerant discharged from the condenser 1112, and may include conditions (#9 to #11) for each of the operating time of the compressor 1120, the operating section of the compressor 1120, and the operating frequency of the compressor 1120, as illustrated in FIG. 10.

Accordingly, the controller 380 may stop the operation of the compressor 1120 when at least one of the operating states including at least one of the temperature change in the air introduced into the evaporator 1111, the temperature change in the air discharged from the evaporator 1111, the temperature change in the refrigerant introduced into the evaporator 1111, the temperature change in the refrigerant discharged from the evaporator 1111, the temperature change in the air introduced into the condenser 1112, the temperature change in the air discharged from the condenser 1112, the temperature change in the refrigerant introduced into the condenser 1112, the temperature change in the refrigerant discharged from the condenser 1112, the operating time of the compressor 1120, the operating section of the compressor 1120, and the operating frequency of the compressor 1120 correspond to the reference condition.

For example, when the controller 380 determines that the temperature change in the air introduced into the evaporator 1111 is maintained at 70° C. or above for 20 minutes or longer in a state where a condition in which the temperature change in the air introduced into the evaporator 1111 is maintained at 70° C. or above for 20 minutes or longer is set to the reference condition, the controller 380 may stop the operation of the compressor 1120 as the determined condition meets the reference condition.

Alternatively, when the controller 380 determines that the change of the operating frequency of the compressor 1120 is maintained within a predetermined range for a predetermined time in a state where a condition in which the change of the operating frequency of the compressor 1120 is maintained within a predetermined range for a predetermined time is set to the reference condition, the controller 380 may stop the operation of the compressor 1120 as the determined condition meets the reference condition.

As described above, the controller 380 that stops the operation of the compressor 1120 based on the reference condition may change the setting of the reference condition by reflecting a weighted value to the reference condition according to an external temperature and an operating state of the clothes treating apparatus 1000.

For example, according to the weather or an amount of water in the clothes treating apparatus 1000, the controller 380 may change the setting of the reference condition by reflecting a weighted value to the reference condition.

For a more specific example, in winter or when the external temperature of the clothes treating apparatus 1000 is below a predetermined temperature, the controller 380 may change the setting of the reference condition by reflecting a weighted value of ±A ° C. to the reference condition so that a state in which the temperature of the air circulation passage decreases is reflected to the reference condition.

Accordingly, stoppage of the compressor 1120 according to at least one of the surrounding environment and the operating state of the clothes treating apparatus 1000 may be appropriately performed.

As described above, the controller 380 that stops the operation of the compressor 1120 according to whether or not the reference condition is satisfied, when at least one of the temperature change and the operating state corresponds to the reference condition after driving the compressor 1120, stops the operation of the compressor 1120 to allow the surface temperature to be at or above the reference temperature, so that the sterilizing operation is performed.

That is, the controller 380 drives the compressor 1120 and stops the operation of the compressor 1120 when at least one of the temperature change and the operating state corresponds to the reference condition, so that the surface temperature is at or above the reference temperature.

Figure 11A:
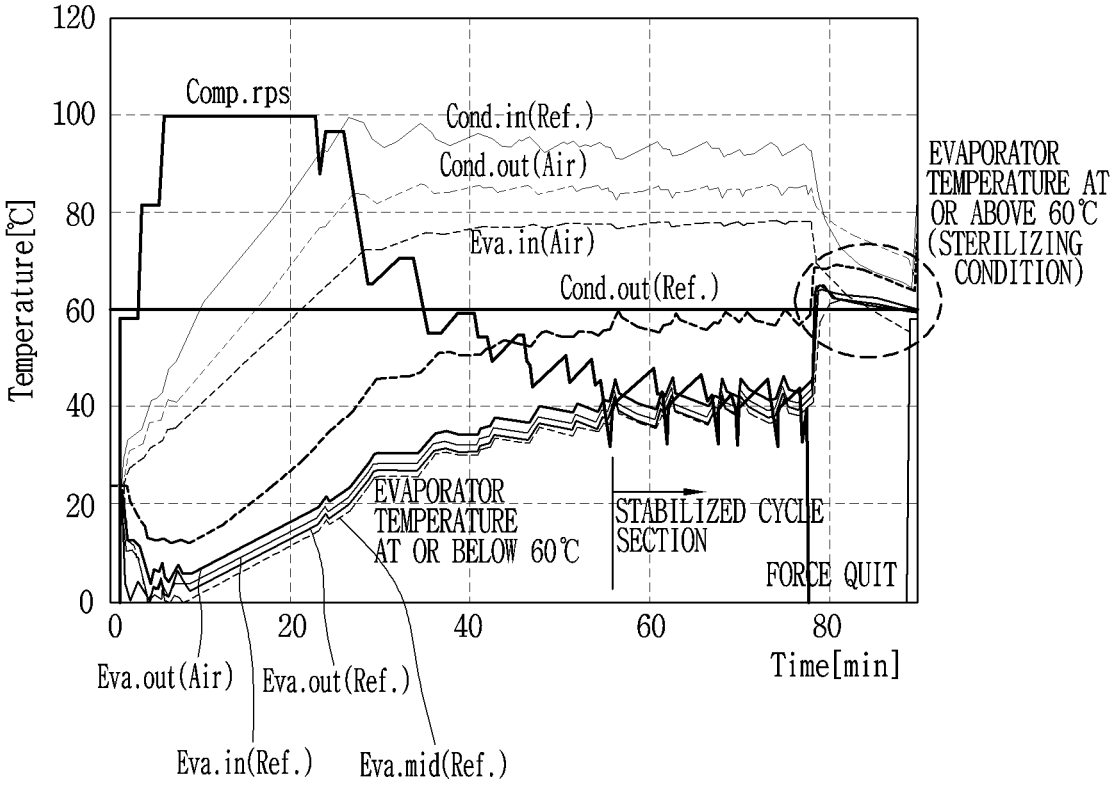
FIG. 11A is an exemplary view 1 explaining a principle of high-temperature sterilization related to an embodiment.

For example, as illustrated in FIG. 11A, after driving the compressor 1120, when the operating frequency of the compressor 1120 corresponds to a cycle stabilization section pulsating at a constant frequency for a predetermined time, the controller may stop the operation of the compressor 1120 to control the surface temperature to be at or above the reference temperature of 60° C.

Specific examples of the controller 380 stopping the operation of the compressor 1120 according to at least one of the temperature change and the operating state are as follows.

After driving the compressor 1120, the controller 380 may stop the operation of the compressor 1120 when the temperature of the air circulating in the evaporator 1111 is maintained at or above a predetermined temperature for a predetermined time.

For example, as illustrated in FIG. 11A, when the temperature of the air circulating in the evaporator 1111 Eva.in—Air is maintained at or above a predetermined temperature (70° C.) for a predetermined period of time (55 to 75 min section=>20 min), the controller 380 may stop the operation of the compressor 1120 to make the surface temperature to be 60° C. or above.

The controller 380 may stop the operation of the compressor 1120 when the temperature of the air circulating in the evaporator 1111 is changed within a predetermined range for a predetermined time after driving the compressor 1120.

For example, as illustrated in FIG. 11A, when the temperature of the air circulated in the evaporator 1111 Eva.in—Air changes within a predetermined range X ±5° C. for a predetermined time (55 to 75 min section=>20 min), the controller 380 may stop the operation of the compressor 1120 to make the surface temperature to be 60° C. or above.

After driving the compressor 1120, the controller 380 may stop the operation of the compressor 1120 when the temperature of the air circulated in the condenser 1112 is maintained at or above a predetermined temperature for a predetermined time.

For example, as illustrated in FIG. 11A, when the temperature of the air circulated in the condenser 1112 Cond.in—Air is maintained at or above a predetermined temperature (90° C.) for a predetermined time (55 to 75 min section=>20 min), the controller 380 may stop the operation of the compressor 1120 to make the surface temperature to be 60° C. or above.

The controller 380 may stop the operation of the compressor 1120 when the temperature of air circulated in the condenser 1112 is changed within a predetermined range for a predetermined time after driving the compressor 1120.

For example, as illustrated in FIG. 11A, when the temperature of the air circulating in the condenser 1112 Cond.in—Air changes within a predetermined range X ±5° C. for a predetermined time (55 to 75 min section=>20 min), the controller 380 may stop the operation of the compressor 1120 to make the surface temperature to be 60° C. or above.

After driving the compressor 1120, the controller 380 may stop the operation of the compressor 1120 when the operating frequency of the compressor 1120 is maintained at or below a predetermined frequency for a predetermined time.

For example, as illustrated in FIG. 11A, when the operating frequency of the compressor 1120 Comp.rps is maintained at or below a predetermined frequency (40 HZ) for a predetermined period of time (55 to 75 min section=>20 min), the controller 380 may stop the operation of the compressor 1120 to make the surface temperature to be 60° C. or above.

After driving the compressor 1120, the controller 380 may stop the operation of the compressor 1120 when a change in the operating frequency of the compressor 1120 is within a predetermined range for a predetermined time.

For example, as illustrated in FIG. 11A, when the change in the operating frequency of the compressor 1120 Comp.rps is made within a predetermined ranged of frequency (±10 HZ) for a predetermined period of time (55 to 75 min section=>20 min), the controller 380 may stop the operation of the compressor 1120 to make the surface temperature to be 60° C. or above.

As described above, when the controller 380 stops the operation of the compressor 1120 as at least one of the temperature change and the operating state corresponds to the reference condition, the surface temperature of the evaporator 1111 rises due to a thermal equilibrium caused by stopping the operation of the compressor 1120. Accordingly, the surface temperature rises up to or above the reference temperature so that the evaporator 1111 can be sterilized at or above the reference temperature.

More specifically, while the compressor 1120 is operated to maintain the heat pump cycle, the temperature of each of the air circulation passage and the condenser 1112 is maintained at or above a predetermined temperature by the heat pump cycle. However, when the operation of the compressor 1120 is stopped, the heat pump cycle is stopped, such that the temperature of the air circulation passage and the condenser 1112 cannot be maintained, and heat from at least one of the air circulation passage and the condenser 1112 moves to the evaporator 1111 to cause a thermal equilibrium. Accordingly, the temperature of the air circulation passage and the condenser 1112 drops and the surface temperature of the evaporator 1111 rises, so that the surface temperature rises up to or above the reference temperature.

Here, the reference temperature is a temperature capable of sterilizing one or more bacteria contained in the condensate, and may be set to, for example, 60° C.

Accordingly, the controller 380 may control the operation of the compressor 1120 to allow the surface temperature to be at 60° C. or higher.

The controller 380 may control the surface temperature to be maintained at or above the reference temperature for the reference time by stopping the operation of the compressor 1120 for a predetermined reference time.

That is, the controller 380 may maintain the stoppage of the compressor 1120 for the reference time to control the surface temperature to stay at or above the reference temperature for the reference time.

Here, the reference time may refer to a time duration during which a sterilization on the evaporator 1111 is performed, and may be set to, for example, 10 minutes or longer.

That is, the reference time may be a time duration for which the sterilizing operation is performed.

Accordingly, the sterilizing operation on the evaporator 1111 may be performed for the reference time.

FIG. 11B is a table showing a result of a sterilization test for *Staphylococcus aureus* that is one of the bacteria contained in the condensate. When sterilized for more than 10 minutes at or above 60° C., a death rate of *Staphylococcus aureus* can be 99% or more, as shown in FIG. 11B.

That is, when the reference temperature is set to 60° C. and the reference time is set to 10 minutes or longer, the *Staphylococcus aureus* existing in the evaporator 1111 can be effectively sterilized.

Accordingly, the controller 380 controls the operation of the compressor 1120 to allow the sterilizing operation on the evaporator 1111 to be maintained at or above the reference temperature (60° C.) for the reference time (10 minutes) so that the *Staphylococcus aureus* existing in the evaporator 1111 is effectively sterilized.

The reference time may be set according to the operating frequency of the compressor 1120.

For example, the reference time may be set corresponding to a magnitude of the operating frequency before the compressor 1120 is stopped.

Specifically, when the magnitude of the operating frequency before stopping the operation of the compressor 1120 is smaller than a reference value, the reference time may be set to be longer as much as it is smaller than the reference value, and when the magnitude of the operating frequency is greater than the reference value, the reference time may be set to be shorter as much as it is greater than the reference value.

Accordingly, after stopping the operation of the compressor 1120, the controller 380 may maintain the stoppage of the compressor 1120 according to the magnitude of the operating frequency before stopping the operation of the compressor 1120.

That is, the controller 380 may stop the operation of the compressor 1120 for a period of time corresponding to the magnitude of the operating frequency before stopping the operation of the evaporator 1111, so that the evaporator 1111 is sterilized for the above described period of time.

As such, the controller 380 controlling the surface temperature to be maintained at or above the reference temperature for the reference time by stopping the operation of the compressor 1120 for the reference time, may complete the sterilizing operation when the reference time elapses.

That is, the controller 380 may control the sterilizing operation to be performed for the reference time.

In this way, the controller 380 controlling the sterilizing operation may maintain the operation of the drum 1030 while the sterilizing operation is performed.

Accordingly, the controller 380 may control the surface temperature to be at or above the reference temperature by promoting the thermal equilibrium in the air circulation passage through the operation of the drum 1030.

The controller 380 may also control the operation of the circulation fan 1710 during the sterilizing operation.

For example, the controller 380 may drive the circulation fan 1710 together with the compressor, or maintain the operation of the circulation fan 1710 while the compressor 1120 is being stopped, to promote a thermal equilibrium on the air circulation passage by the operation of the circulation fan, so that the surface temperature rises up to or above the reference temperature.

Figure 12:
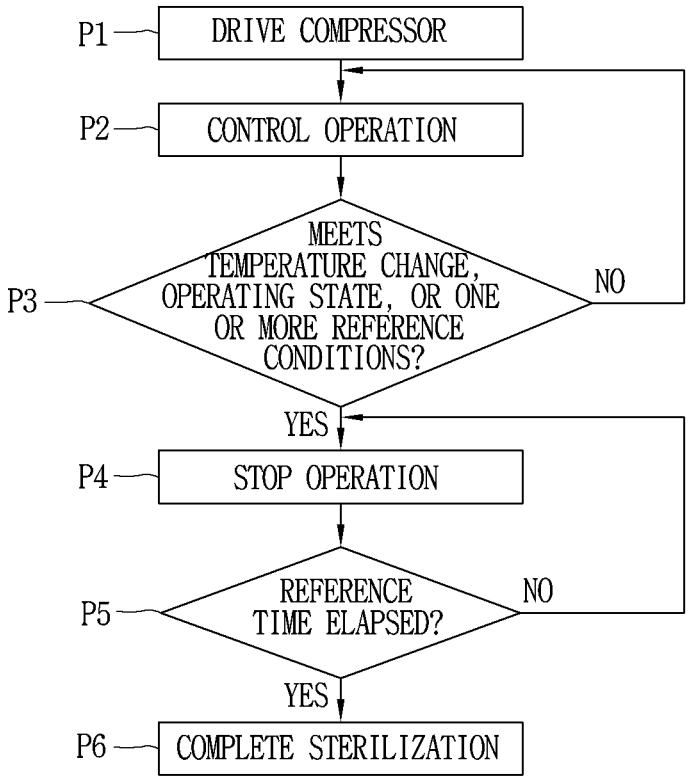
FIG. 12 is a flowchart illustrating a process of performing a sterilizing operation according to an embodiment.

The process of controlling the sterilizing operation by the controller 380 described above may be performed in the order illustrated in FIG. 12.

The controller 380 may control the sterilizing operation such that, firstly, driving the compressor 1120 [P1], and then controlling the operation of the compressor 1120 [P2] to configure the heat pump cycle. Here, the controller 380 may control the operation of the compressor 1120 [P2] by determining the temperature change and the operating state to drive the compressor 1120 until at least one of the temperature change and the operating state corresponds to the reference condition [P3]. When at least one of the temperature change and the operating state does not correspond to the reference condition [P3], the controller 380 may maintain the operation of the compressor 1120 [P2]. And, when at least one of the temperature change and the operating state corresponds to the reference condition [P3], the controller 380 may stop the operation of the compressor 1120 [P4]. After stopping the operation of the compressor 1120, the controller 380 may maintain [P4] the stoppage of the operation of the compressor 1120 until the stoppage time duration of the compressor 1120 exceeds the reference time [P5], and when the stoppage time duration of the compressor 1120 exceeds the reference time [P5], the controller 380 may complete the sterilizing operation [P6].

[Clothes Treating Apparatus]

Hereinafter, an embodiment of a clothes treating apparatus will be described, but descriptions repeating the above-mentioned contents may be omitted, and a specific embodiment of the clothes treating apparatus will be mainly described.

The clothes treating apparatus according to the embodiment is the clothes treating apparatus illustrated in FIG. 5A or 6A, and may be the clothes treating apparatus 1000 described above.

Figure 13:
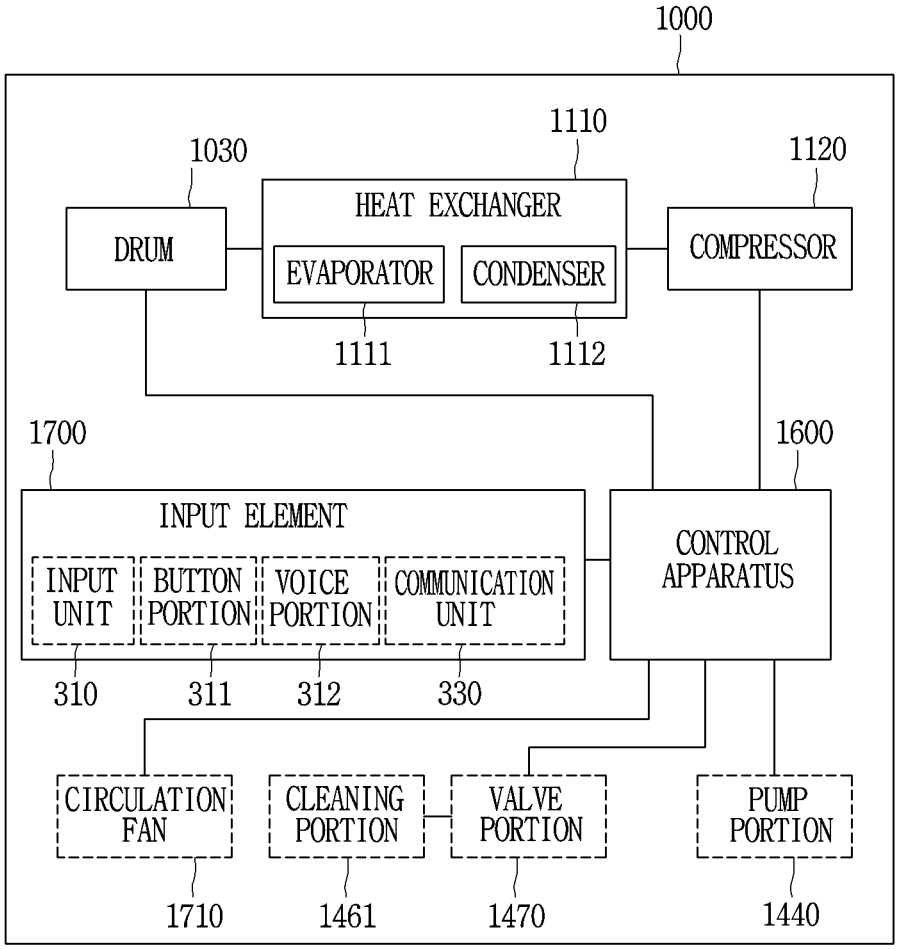
FIG. 13 is a block diagram illustrating a configuration according to an embodiment of a clothes treating apparatus.

The clothes treating apparatus 1000 includes the drum 1030 rotatably installed inside a main body of the clothes treating apparatus 1000; the heat exchanger 1110 provided at an air circulation passage connected to the drum 1030 and including the evaporator 1111 and the condenser 1112 that exchange heat with air circulating in the air circulation passage; the compressor 1120 configured to compress the refrigerant circulated through the heat exchanger 1110 and exchanging heat with the air circulating in the air circulation passage; input elements 1700 in which a control input for an operation mode of the clothes treating apparatus is applied; and the control apparatus 1600 configured to control an operation of the drum 1030 or an operation of the compressor 1120, or both, so that an operation according to the operation mode is performed in response to the control input, as illustrated in FIG. 13.

That is, the clothes treating apparatus 1000 may perform the operation according to the operation mode, as the control apparatus 1600 controls the operation of at least one of the drum 1030 and the compressor 1120 in response to a control input for the operation mode received through the input elements 1700.

Here, the control apparatus 1600 may be the control apparatus 1600 described above.

As described above, when a control input on a specific mode for controlling the surface temperature of the evaporator 1111 is applied, the control apparatus 1600 configured to control the clothes treating apparatus 1000 so that the operation according to the operation mode is performed controls the surface temperature to be at or above a predetermined reference temperature by stopping the operation of the compressor 1120 when at least one of the temperature change of the evaporator 1111 and the operating state of the compressor 1120 corresponds to the predetermined reference condition after driving the compressor 1120.

That is, when the control input for the specific mode is applied, the control apparatus 1600 may drive the compressor 1120 until at least one of the temperature change and the operating state corresponds to the reference condition, then stop the operation of the compressor 1120 so that the surface temperature stays at or above the reference temperature.

Here, the specific mode may be a mode that operates such that the surface temperature rises up to or above the reference temperature.

The specific mode may be, for example, a sterilization mode for sterilizing the evaporator 1111.

That is, when a control input for the sterilization mode for sterilizing the evaporator 1111 is applied through the input elements 1700, the control apparatus 1600 may drive the compressor 1120 until at least one of the temperature change and the operating state corresponds to the reference condition, then stop the operation of the compressor 1120 so that the surface temperature stays at or above the reference temperature to sterilize the evaporator 1111.

The sterilization mode is a mode that sterilizes the evaporator 1111 among the operation modes of the clothes treating apparatus 1000, and may be a mode of sterilizing the evaporator 1111 contaminated by the condensate.

The specific mode may be a mode performed while the object for drying is not accommodated in the drum 1030.

That is, the sterilization mode may be performed in the no-load state in which the object for drying is not accommodated in the drum 1030.

Accordingly, the sterilization mode is a mode performed in the no-load state in which the object for drying is not accommodated in the drum 1030, and may be performed separately from the drying mode for drying the object.

The control apparatus 1600 may allow a control input for the specific mode to be applied, but when the object for drying is accommodated in the drum 1030, the control apparatus 1600 may control an operation according to the specific mode not to be performed.

That is, when a control input for the specific mode is applied in a loaded state, the control apparatus 1600 may control the operation according to the specific mode not to be performed.

In addition, when the control input for the specific mode is applied in the loaded state, the control apparatus 1600 may also control a display to indicate that the drum is not in the no-load state on the outside of the clothes treating apparatus 1000.

For example, the control apparatus 1600 may transmit information indicating the loaded state to a remote control means configured to remotely control the clothes treating apparatus 1000 or may control the output unit 320 to display the loaded state.

The input element 1700, in which the control input is applied, may refer to a means in which an operation input to control the operation of the clothes treating apparatus 1000 is applied by a user.

The input elements 1700 may include at least one of the input unit 310 for manipulation of the operation control of the clothes treating apparatus 1000, a button portion 311 for push manipulation for performing the sterilization mode, a voice portion 312 through which voice for the operation control of the clothes treating apparatus 1000 is inputted, and the communication unit 330 configured to communicate with communication means external to the clothes treating apparatus 1000.

That is, the control input for the specific mode may be applied through at least one of the input unit 310, the button portion 311, the voice portion 312, and the communication unit 330.

The input unit 310 may be configured as a control panel on which a manipulation of the operation control of the clothes treating apparatus 1000 is made, so that a control input for performing the sterilization mode is applied in response to the manipulation on the control panel.

The button portion 311 is a button provided on an outer surface of the clothes treating apparatus 1000 or on the input unit 310, and a control input for performing a specific bacteria mode may be applied in response to a push of the button.

For example, when the button portion 311 is pushed, a control input for performing the specific mode is applied, so that the control apparatus 1600 can control an operation of the specific mode.

Here, the button portion 311 may include a dedicated button for performing the specific mode.

The voice portion 312 is the input unit 310 or a voice recognition means provided in the input unit 310 and may be input a voice command of a user of the clothes treating apparatus 1000, so a control input for performing the specific mode may be applied by inputting the voice command.

For example, when a voice including "specific", "sterilization", "sterilizing operation" or "sterilization mode" is inputted, a control input for performing the specific mode is applied, so that the control apparatus 1600 can control the operation of the specific mode.

The communication unit 330 is a communication means to communicate with at least one of the external network and the remote control means of the clothes treating apparatus 1000, in which a control input for performing the specific mode may be applied in response to a control command transmitted from at least one of the external network and the remote control means of the clothes treating apparatus 1000.

Accordingly, when a control input for the specific mode is applied through at least one of the input unit 310, the button portion 311, the voice portion 312, and the communication unit 330 included in the input elements 1700, the control apparatus 1600 may drive the compressor 1120 until at least one of the temperature change and the operating state corresponds to the reference condition, then stop the operation of the compressor 1120 so that the surface temperature stays at or above the reference temperature.

The control apparatus 1600 to control the operation according to the specific mode when a control input for the specific mode is applied, may stop the operation of the compressor 1120 for the reference time.

That is, when the control apparatus 1600 controls the specific mode to be performed, the control apparatus 1600 may drive the compressor 1120 until at least one of the temperature change and the operating state corresponds to the reference condition, then stop the operation of the compressor 1120 for the reference time so that the surface temperature stays at or above the reference temperature, and thereby sterilizing the compressor 1120 for the reference time.

As described above, when a control input for the specific mode is applied through the input elements 1700, the control apparatus 1600 drives the compressor 1120 until at least one of the temperature change and the operating state corresponds to the reference condition, then stops the operation of the compressor 1120 so that the surface temperature is to be at or above the reference temperature to perform the specific mode. Here, the operation of the clothes treating apparatus 1000 is controlled by the control apparatus 1600, and the clothes treating apparatus 1000 further includes the circulation fan 1710 configured to generate a flow of air in which the air is passing through the condenser 1112 to be introduced into the drum 1030. In addition, the control apparatus 1600 may drive the circulation fan 1710 while stopping the operation of the compressor 1120.

That is, the control apparatus 1600 may control the surface temperature to be at or above the reference temperature by driving the circulation fan 1710 to generate a flow of air, while stopping the operation of the compressor 1120.

Here, the circulation fan 1710 may be operated while the compressor 1120 is operating.

That is, the control apparatus 1600 may drive the circulation fan 1710 while the compressor 1120 is operating.

The control apparatus 1600 may drive the circulation fan 1710 by changing the rotation speed of the circulation fan 1710 while stopping the operation of the compressor 1120.

For example, when the compressor 1120 is operating, the circulation fan 1710 may rotate at a speed of X [HZ], and when the compressor 1120 stops operating, the circulation fan 1710 may rotate at a speed of X-Y [HZ].

The control apparatus 1600 may drive the circulation fan 1710 according to the number of times the operation of the compressor 1120 is stopped.

For example, when the operation of the compressor 1120 is stopped twice or more, the control apparatus 1600 may drive the circulation fan 1710.

The control apparatus 1600 may also stop the operation of the circulation fan 1710 while stopping the operation of the compressor 1120.

For example, when the operation of the compressor 1120 is stopped less than twice, the control apparatus 1600 may not drive the circulation fan 1710.

When a control input for the specific mode is applied through the input elements 1700, the control apparatus 1600 drives the compressor 1120 until at least one of the temperature change and the operating state corresponds to the reference condition, then stops the operation of the compressor 1120 so that the surface temperature is to be at or above the reference temperature to perform the specific mode. Here, the clothes treating apparatus 1000 further includes the pump portion 1440 configured to drain condensate collected in the water tank installed in a lower side of the heat exchanger 1110 to outside of the water tank. In addition, the control apparatus 1600 may control the operation of the pump portion 1440 so that the condensate is drained before driving the compressor 1120, and after the stoppage of the operation of the compressor 1120.

That is, the control apparatus 1600 controls the operation of the pump portion 1440 before driving the compressor 1120 and after stopping the operation of the compressor 1120 to allow the condensate to be drained from the water tank. By doing so, the condensate collected before and after the evaporator 1111 is sterilized is removed.

Accordingly, sterilization of the evaporator 1111 before the sterilization mode operation can be appropriately performed, and by removing a cause of contamination remaining in the water tank after the sterilization mode operation, sterilization can be effectively performed.

When a control input for the specific mode is applied through the input elements 1700, the control apparatus 1600 drives the compressor 1120 until at least one of the temperature change and the operating state corresponds to the reference condition, then stops the operation of the compressor 1120 so that the surface temperature is to be at or above the reference temperature to perform the specific mode. Here, the clothes treating apparatus 1000 further includes the cleaning portion 1461 configured to spray cleaning water to clean the surface of the evaporator 1111 toward the surface of the evaporator 1111, and the valve portion 391 having a plurality of cleaning water ports to form a part of a path through which the cleaning water flows. In addition, the control apparatus 1600 may control the operation of the evaporator 1111 so that the cleaning water is sprayed based on the predetermined reference for spraying before the operation of the compressor 1120, and after the stoppage of the operation of the compressor 1120.

That is, the control apparatus 1600 controls the operation of the valve portion 391 before driving the compressor 1120 and after stopping the operation of the compressor 1120 to allow the cleaning water to be sprayed on the evaporator 1111 according to the reference for spraying. By doing so, the evaporator 1111 is cleaned before and after the evaporator 1111 is sterilized.

The reference for spraying may be a reference on at least one of a timing, a region, a time duration and number of times the cleaning water is sprayed.

For example, the cleaning water may be set to be sprayed at a predetermined time, over a predetermined region, for a predetermined time duration and by a predetermined number of times or more.

The reference for spraying may be set differently before driving the compressor 1120 and after stopping the operation of the compressor 1120.

For example, a reference for spraying before driving the compressor 1120 and a reference for spraying after stopping the operation of the compressor 1120 may be set differently.

Accordingly, the control apparatus 1600 may control the operation of the valve portion 391, such that the cleaning water is sprayed according to the respective references for spraying before driving the compressor 1120 and after stopping the operation of the compressor 1120.

[Method for Controlling Clothes Treating Apparatus]

Hereinafter, an embodiment of a method for controlling a clothes treating apparatus will be described, but descriptions repeating the above-mentioned contents may be omitted, and a specific embodiment of the method for controlling the clothes treating apparatus will be mainly described.

A method for controlling a clothes treating apparatus according to an embodiment (hereinafter, referred to as a control method) is a control method for a clothes treating apparatus including a heat exchanger 1110 provided at an air circulation passage connected to a drum 1030 and including an evaporator 1111 and a condenser 1112 that exchange heat with air circulating in the air circulation passage, a compressor 1120 configured to compress a refrigerant; and a circulation fan 1710 configured to generate a flow of air in which the air is passing through the condenser 1112 to be introduced into the drum 1030, which may be a method for controlling an operation of the clothes treating apparatus 1000 described above.

The clothes treating apparatus 1000 includes the drum 1030 rotatably installed inside a main body that defines an exterior of the clothes treating apparatus, the heat exchanger 1110; the compressor 1120, the circulation fan 1710, a cleaning portion 1461 configured to spray cleaning water to clean the surface of the evaporator 1111 toward the surface of the evaporator 1111, and a valve portion having a plurality of cleaning water ports to form a part of a path through which the cleaning water flows, wherein the operation of the clothes treating apparatus may be controlled according to the control method.

The control method may also be a control method in which the control apparatus 1600 as illustrated in FIG. 5A or 6A controls the clothes treating apparatus 1000.

That is, the control method may be applied to the clothes treating apparatus 1000 or the control apparatus 1600 described above.

Figure 14:
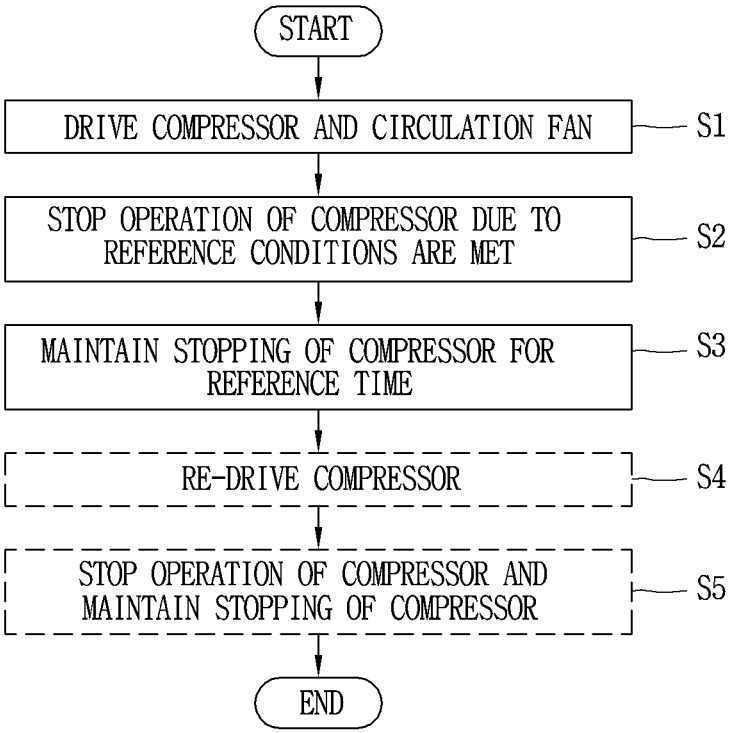
FIG. 14 is a flowchart illustrating a sequence according to an embodiment of a method for controlling a clothes treating apparatus.

The control method is a method for controlling the operation of the clothes treating apparatus 1000, as illustrated in FIG. 14, the method includes driving the compressor 1120 and the circulation fan 1710 [S1], stopping the operation of the compressor 1120 when at least one of the temperature change of the evaporator 1111 and the operating state of the compressor 1120 corresponds to a predetermined reference condition [S2], maintaining the stoppage of the operation of compressor 1120 for a predetermined reference time [S3].

That is, the clothes treating apparatus 1000 may drive the compressor 1120 and the circulation fan 1710 [S1], and stop the operation of the compressor 1120 when at least one of the temperature change and the operating state corresponds to the reference condition [S2] to maintain the stoppage of the operation of compressor 1120 for the reference time [S3].

Here, in the maintaining step [S3], the circulation fan 1710 may be operated by changing the rotation speed of the circulation fan 1710 after the operation of the compressor 1120 is stopped.

That is, while the operation of the compressor 1120 is stopped for the reference time, the circulation fan 1710 may be operated by changing the rotation speed.

For example, the circulation fan 1710 may be operated at a speed slower than the rotation speed when the compressor 1120 is operated during the reference time.

The control method including the driving step [S1], the stopping step [S2] and the maintaining step [S3] may be a method for controlling any one operation mode of the clothes treating apparatus 1000.

That is, the control method may be a method for driving the compressor 1120 and the circulation fan 1710 [S1], stopping the operation of the compressor 1120 when at least one of the temperature change and the operating state corresponds to the reference condition [S2], and maintaining the stoppage of the operation of compressor 1120 for the reference time [S3].

For example, the control method may be a method for controlling a specific mode, such that the operation of the clothes treating apparatus 1000 is controlled by the driving step [S1], the stopping step [S2], and the maintaining step [S3].

The control method including the driving [S1], the stopping [S2], and the maintaining [S3] may further include restarting the compressor 1120 [S4] and repeatedly performing [S5] the stopping [S2] and the maintaining [S3].

The step of restarting [S4] may be a step of re-driving the compressor 1120 after maintaining [S3] the stoppage of the operation of the compressor 1120 for the reference time.

The step of performing repetition [S5] may be a step of, after re-driving the compressor 1120 [S4], stopping the operation of the compressor 1120 when at least one of the temperature change and the operating state corresponds to the reference condition [S2], then maintaining the stoppage of the operation of compressor 1120 for the reference time [S3].

That is, in the step of performing repetition [S5], after re-driving compressor 1120 [S4], the step of stopping [S2] and the step of maintaining [S3] may be repeatedly performed.

Accordingly, in the control method, stopping the operation of the compressor 1120 [S2] and maintaining the stoppage of the operation of the compressor [S3] may be repeatedly performed a plurality of times.

Figure 15:
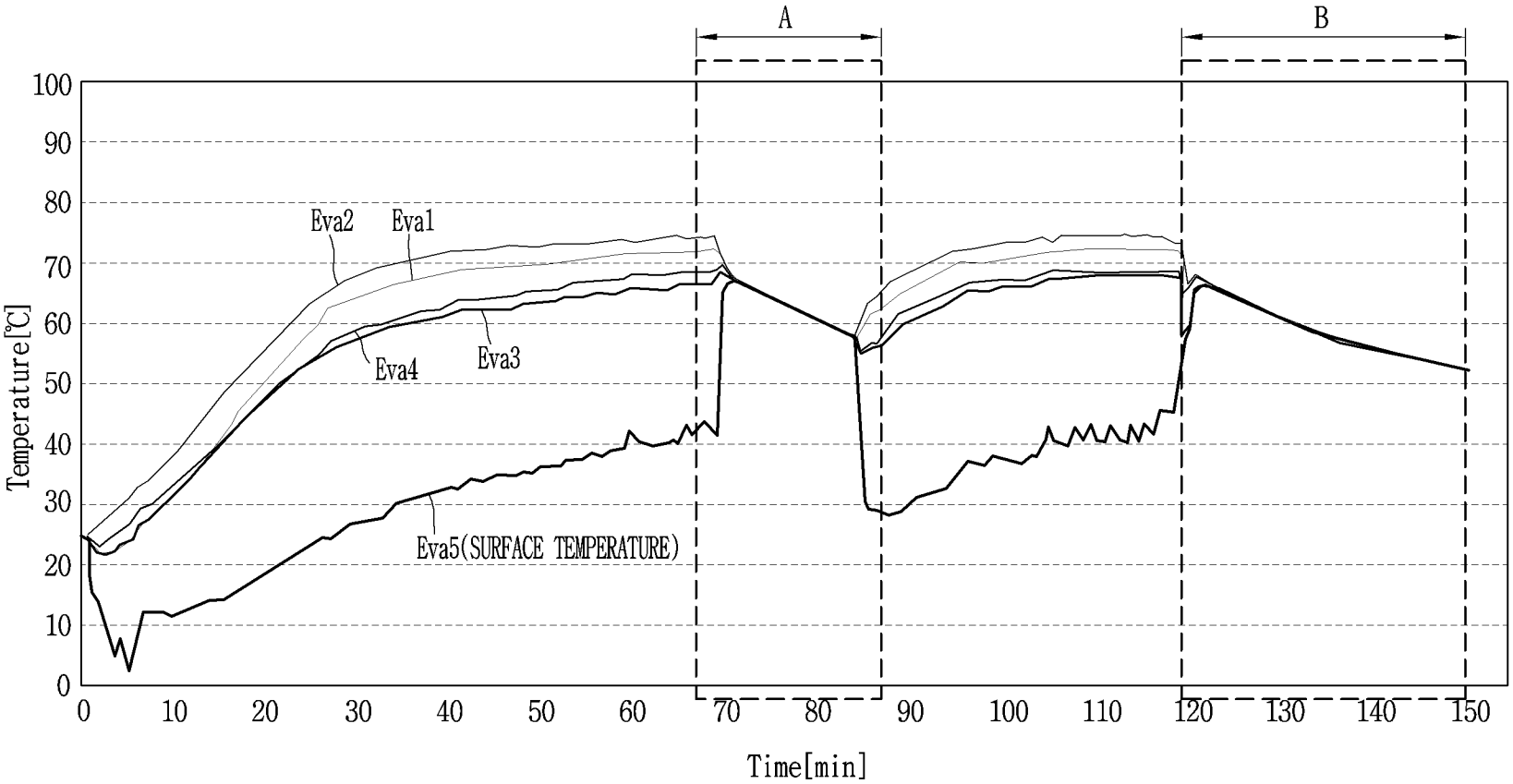
FIG. 15 is an exemplary view illustrating an implementation result according to a detailed embodiment of a method for controlling a clothes treating apparatus.

For example, as illustrated in FIG. 15, by repeatedly performing the stopping of the compressor 1120 and the maintaining the stoppage for the reference time for two times (section A and section B) under the reference condition, the surface temperature can be at or above the reference temperature for two times.

Figure 16A:
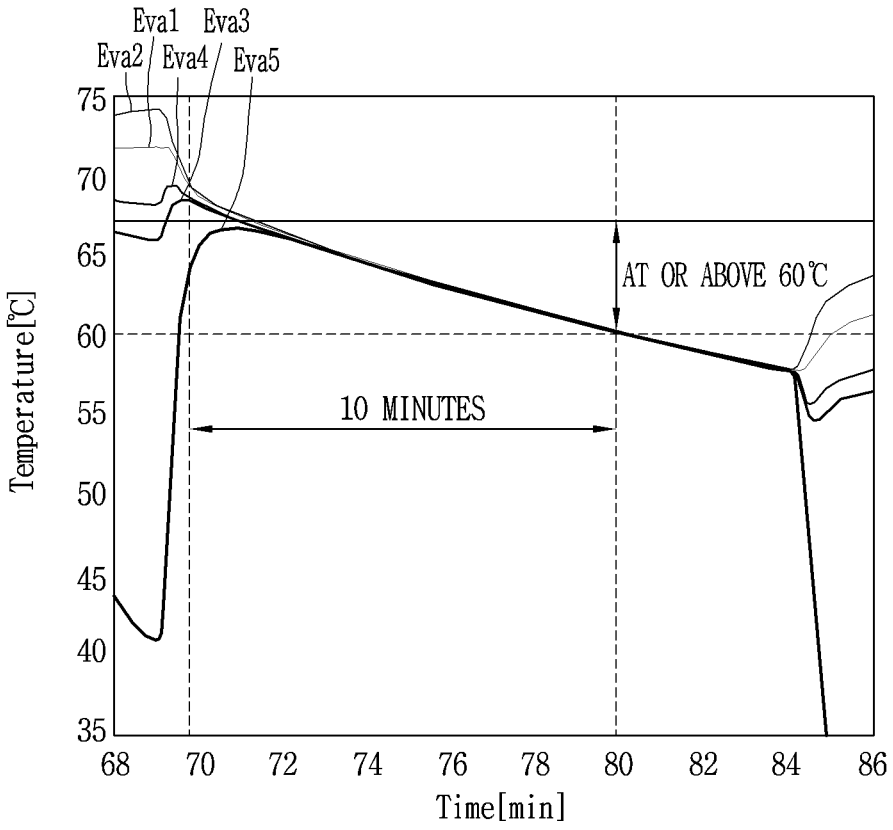
FIG. 16A is an enlarged view of section A in the graph in FIG. 15.
Figure 16B:
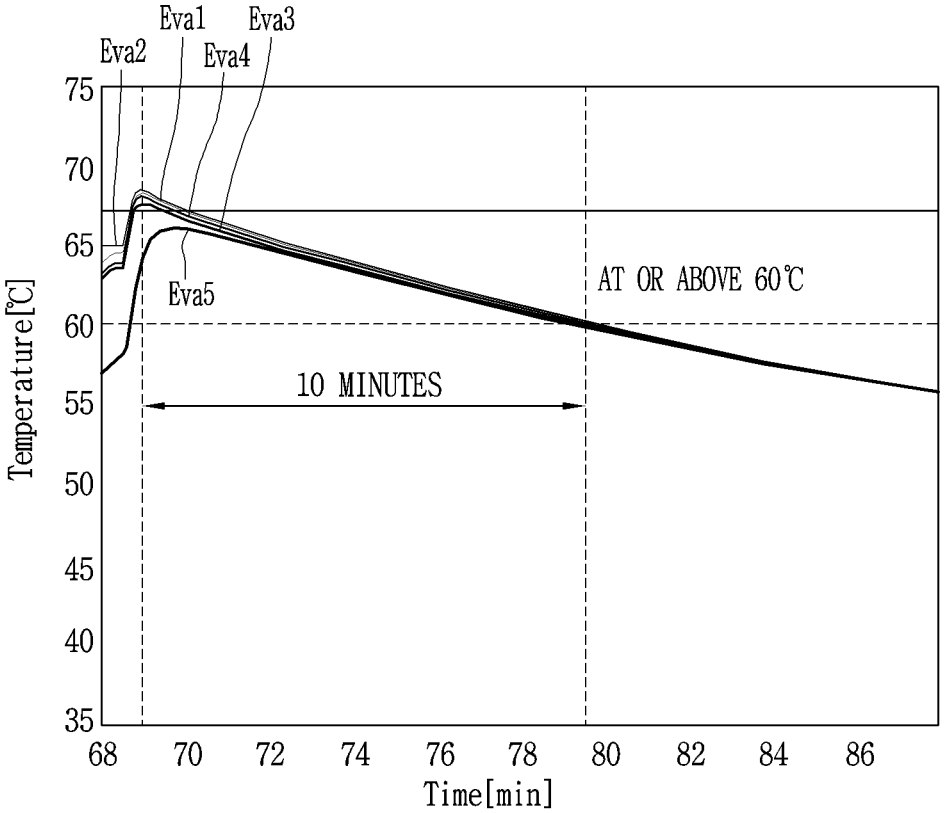
FIG. 16B is an enlarged view of section B in the graph in FIG. 15.
Figure 17:
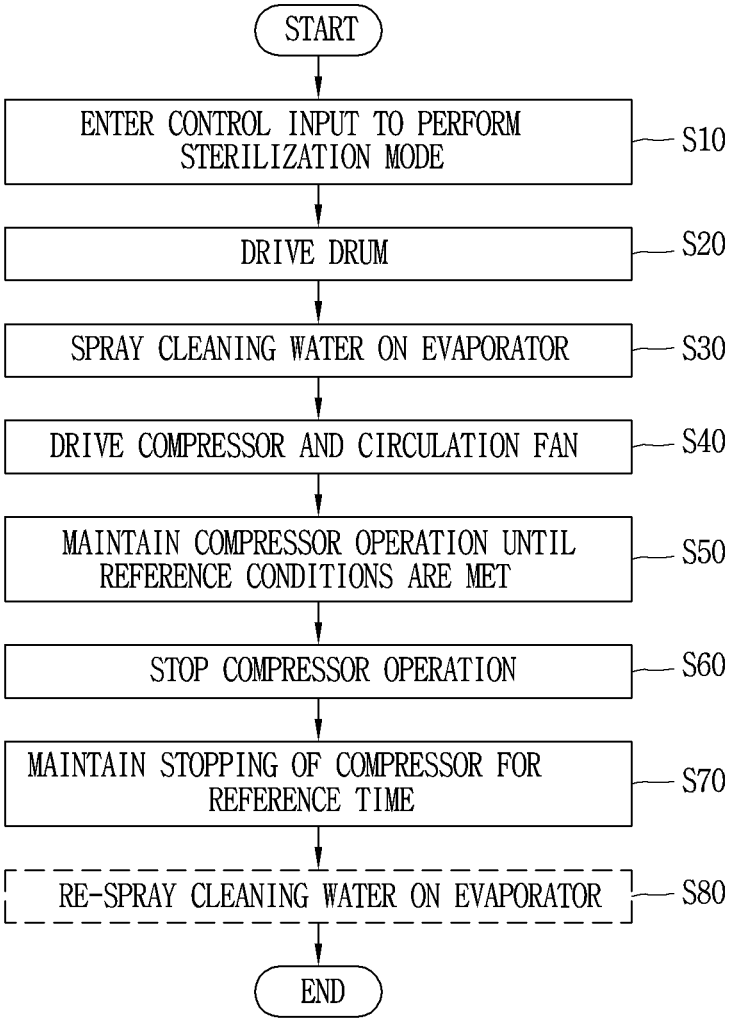
FIG. 17 is a flowchart illustrating a sequence according to a detailed embodiment of a method for controlling a clothes treating apparatus.

In this case, the reference time is set to 10 minutes, and as illustrated in FIGS. 16A and 16B, the operation of the compressor 1120 may be stopped for 10 minutes in the section A and the section B, respectively.

According to this, as a time duration where the evaporator 1111 stays at or above the reference temperature is a total of 20 minutes, that is, a total sterilization time is 20 minutes, a sterilization rate can be close to 99.999% (see, FIG. 11B).

In this way, the control method may control the operation of the clothes treating apparatus 1000, so that the operation according to the specific mode is repeatedly performed two or more times.

Accordingly, the clothes treating apparatus 1000 may repeatedly perform a specific operation in which driving the compressor 1120 and the circulation fan 1710 [S1], stopping the operation of the compressor 1120 when at least one of the temperature change and the operating state corresponds to the reference condition [S2], and maintaining the stoppage of the operation of compressor 1120 for the reference time [S3], for two or more times.

As described above, a specific control method for controlling the operation of the clothes treating apparatus 1000 includes entering a control input for performing a sterilization mode to sterilize the evaporator 1111 [S10], driving the drum 1030 [S20], spraying the cleaning water on the evaporator 1111 according to a predetermined reference for spraying by controlling the valve portion 391 [S30], driving the compressor 1120 and the circulation fan 1710 [S40], maintaining the operation of the compressor 1120 until at least one of the temperature change of the evaporator 1111 and the operating state of the compressor 1120 corresponds to a predetermined reference condition [S50], stopping the operation of the compressor 1120 when at least one of the temperature change of the evaporator 1111 and the operating state of the compressor 1120 corresponds to the reference condition [S60], and maintaining the stoppage of the operation of compressor 1120 for a predetermined reference time [S70].

That is, the control method may be a method for controlling the operation of the sterilization mode.

Accordingly, the control apparatus 1600 may control the operation of the sterilization mode in the following order of steps, such as entering a control input for performing a sterilization mode to sterilize the evaporator 1111 [S10], driving the drum 1030 [S20], spraying the cleaning water on the evaporator 1111 according to a predetermined reference for spraying by controlling the valve portion 391 [S30], driving the compressor 1120 and the circulation fan 1710 [S40], maintaining the operation of the compressor 1120 until at least one of the temperature change of the evaporator 1111 and the operating state of the compressor 1120 corresponds to a predetermined reference condition [S50], stopping the operation of the compressor 1120 when at least one of the temperature change of the evaporator 1111 and the operating state of the compressor 1120 corresponds to the reference condition [S60], and maintaining the stoppage of the operation of compressor 1120 for a predetermined reference time [S70].

In addition, the sterilization mode may be performed in the clothes treating apparatus 1000 in the following order of steps, such as entering a control input for performing a sterilization mode to sterilize the evaporator 1111 [S10], driving the drum 1030 [S20], spraying the cleaning water on the evaporator 1111 according to a predetermined reference for spraying by controlling the valve portion 391 [S30], driving the compressor 1120 and the circulation fan 1710 [S40], maintaining the operation of the compressor 1120 until at least one of the temperature change of the evaporator 1111 and the operating state of the compressor 1120 corresponds to a predetermined reference condition [S50], stopping the operation of the compressor 1120 when at least one of the temperature change of the evaporator 1111 and the operating state of the compressor 1120 corresponds to the reference condition [S60], and maintaining the stoppage of the operation of compressor 1120 for a predetermined reference time [S70].

The step of entering a control input for performing the sterilization mode to sterilize the evaporator 1111 [S10] may be a step in which a control input for performing the sterilization mode is entered through the input elements 1700 included in the clothes treating apparatus 1000.

Here, the input elements 1700 may include at least one of the input unit 310, the button portion 311, the voice portion 312, and the communication unit 330.

Accordingly, in the step of entering a control input for performing the sterilization mode to sterilize the evaporator 1111 [S10], the control input for performing the sterilization mode may be entered through at least one of the input unit 310, the button portion 311, the voice portion 312, and the communication unit 330.

The step of entering a control input for performing the sterilization mode to sterilize the evaporator 1111 [S10] may be a step of entering a control input for performing the sterilization mode through the input elements 1700 in the no-load state in which the object for drying is not received in the drum 1030.

The step of driving the drum 1030 [S20] may be a step in which the drum 1030 is driven by the control apparatus 1600 according to the control input, after the control input is entered in the step of entering a control input for performing the sterilization mode to sterilize the evaporator 1111 [ S10].

That is, the control apparatus 1600 may drive the drum 1030 after the control input is entered through the input elements 1700.

The step of spraying the cleaning water on the evaporator 1111 according to a predetermined reference for spraying by controlling the valve portion 391 [S30] may be a step in which the control apparatus 1600 controls the valve portion 391 so that the cleaning water is sprayed on the evaporator 1111 according to the reference for spraying, after the drum 1030 is driven in the step of driving the drum 1030 [S20].

That is, the control apparatus 1600 may clean the evaporator 1111 by controlling the valve portion 391 to allow the cleaning water is sprayed on the evaporator according to the reference for spraying, after driving the drum 1030.

The step of driving the compressor 1120 and the circulation fan 1710 [S40] may be a step in which the compressor 1120 and the circulation fan 1710 are respectively operated by the control apparatus 1600 so that a heat pump cycle is implemented, after the evaporator is cleaned in the step of spraying the cleaning water on the evaporator 1111 according to a predetermined reference for spraying by controlling the valve portion 391 [S30].

That is, the control apparatus 1600 may drive the compressor 1120 and the circulation fan 1710, respectively, after controlling the valve portion 391 so that the cleaning water is sprayed on the evaporator 1111 according to the reference for spraying.

The step of maintaining the operation of the compressor 1120 until at least one of the temperature change of the evaporator 1111 and the operating state of the compressor 1120 corresponds to a predetermined reference condition [S50] may be a step in which the control apparatus 1600 determines at least one of the temperature change and the operating state to maintain the operation of the compressor 1120 until at least one of the temperature change and the operating state corresponds to the reference condition, after driving the compressor 1120 and the circulation fan 1710 in the step of driving the compressor 1120 and the circulation fan 1710 [S40].

That is, the control apparatus 1600 may maintain the operation of the compressor 1120 until at least one of the temperature change and the operating state corresponds to the reference condition, after driving the compressor 1120 and the circulation fan 1710.

The step of stopping the operation of the compressor 1120 when at least one of the temperature change of the evaporator 1111 and the operating state of the compressor 1120 corresponds to the reference condition [S60] may be a step in which the control apparatus 1600 stops the operation of the compressor 1120 so that the surface temperature stays at or above a predetermined reference temperature, after maintaining the operation of the compressor 1120 until at least one of the temperature change and the operating state corresponds to the reference condition in the step of maintaining the operation of the compressor 1120 until at least one of the temperature change of the evaporator 1111 and the operating state of the compressor 1120 corresponds to a predetermined reference condition [S50].

That is, when at least one of the temperature change and the operating state corresponds to the reference condition, after maintaining the operation of the compressor 1120 until at least one of the temperature change and the operating state meets the reference condition, the control apparatus 1600 may stop the operation of the compressor 1120 so that the surface temperature stays at or above the reference temperature.

The step of maintaining the stoppage of the operation of compressor 1120 for the reference time [S70] may be a step in which the control apparatus 1600 stops the operation of the compressor 1120 for the reference time, after stopping the operation of the compressor 1120 in the step of stopping the operation of the compressor 1120 when at least one of the temperature change of the evaporator 1111 and the operating state of the compressor 1120 corresponds to the reference condition [S60].

That is, after stopping the operation of the compressor 1120, the control apparatus 1600 may maintain the stoppage of the operation of the compressor 1120 for the reference time so that the surface temperature maintains at or above the reference temperature for the reference time to allow the evaporator 1111 to be sterilized for the reference time.

Also, in the step of maintaining the stoppage of the operation of compressor 1120 for the reference time [S70], the circulation fan 1710 may be operated by changing a rotation speed of the circulation fan 1710 after the operation of the compressor 1120 is stopped.

That is, the control apparatus 1600 may change the rotation speed of the circulation fan 1710 while maintaining the stoppage of the operation of the compressor 1120 for the reference time, so that the surface temperature is maintained at or above the reference temperature due to the operation of the circulation fan 1710.

After maintaining the stoppage of the operation of the compressor 1120 for the reference time, the control apparatus 1600 may complete the operation of the sterilization mode.

The control method for controlling the operation of the sterilization mode may further include re-spraying the cleaning water on the evaporator 1111 [S80].

The step of re-spraying the cleaning water on the evaporator 1111 [S80] may be a step in which the control apparatus 1600 controls the valve portion 391 to spray the cleaning water on the evaporator 1111, after maintaining the stoppage of the operation of the compressor 1120 for the reference time [S70].

That is, the control apparatus 1600 may maintain the stoppage of the operation of the compressor 1120 for the reference time to allow the evaporator 1111 to be sterilized during the reference time, and then re-clean the evaporator 1111.

Meanwhile, the evaporator sterilization method in the embodiments of the apparatus for controlling the clothes treating apparatus, the clothes treating apparatus, and the method for controlling the clothes treating apparatus described above may be implemented in various operation modes for cleaning and sterilizing the evaporator.

Figure 18A:
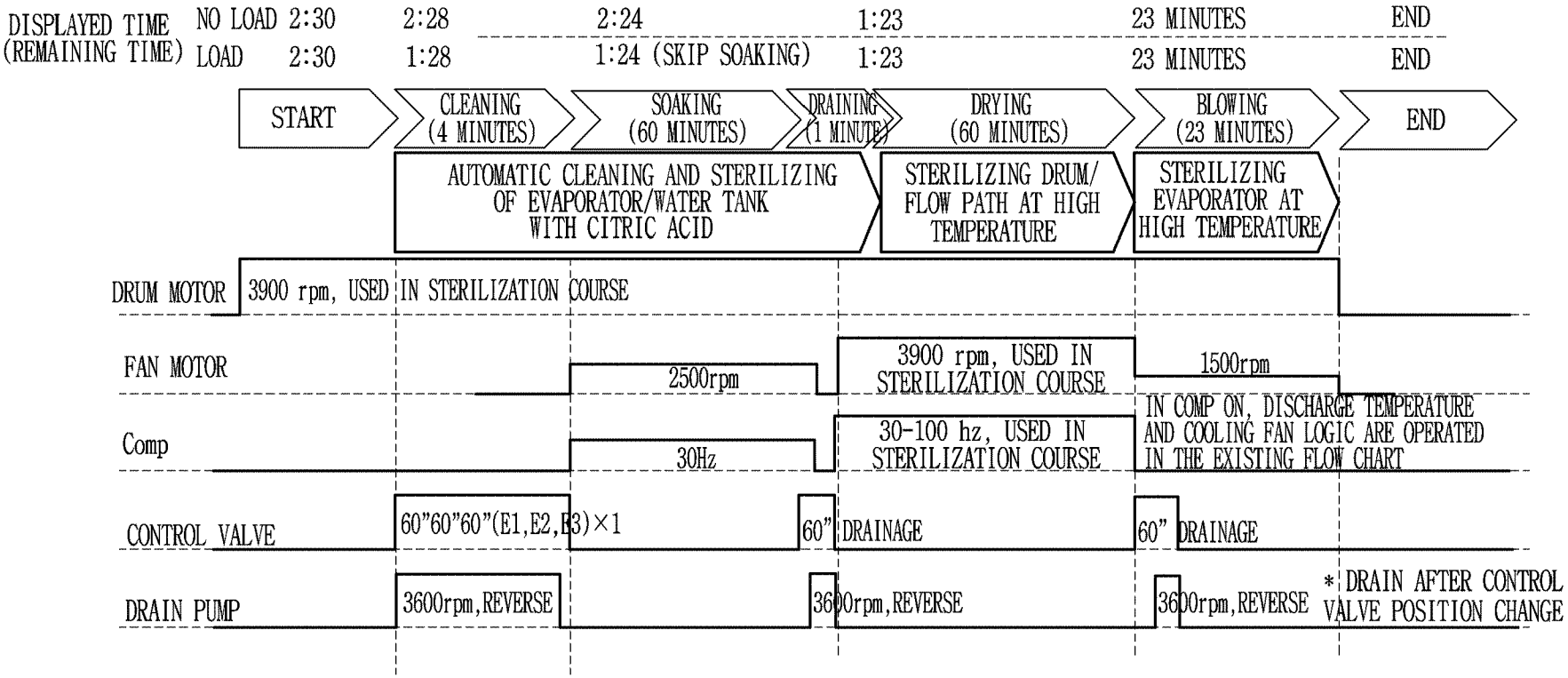
FIG. 18A is an exemplary view illustrating an example of a first operation mode according to a detailed application example of an evaporator sterilization method according to an embodiment.
Figure 18B:
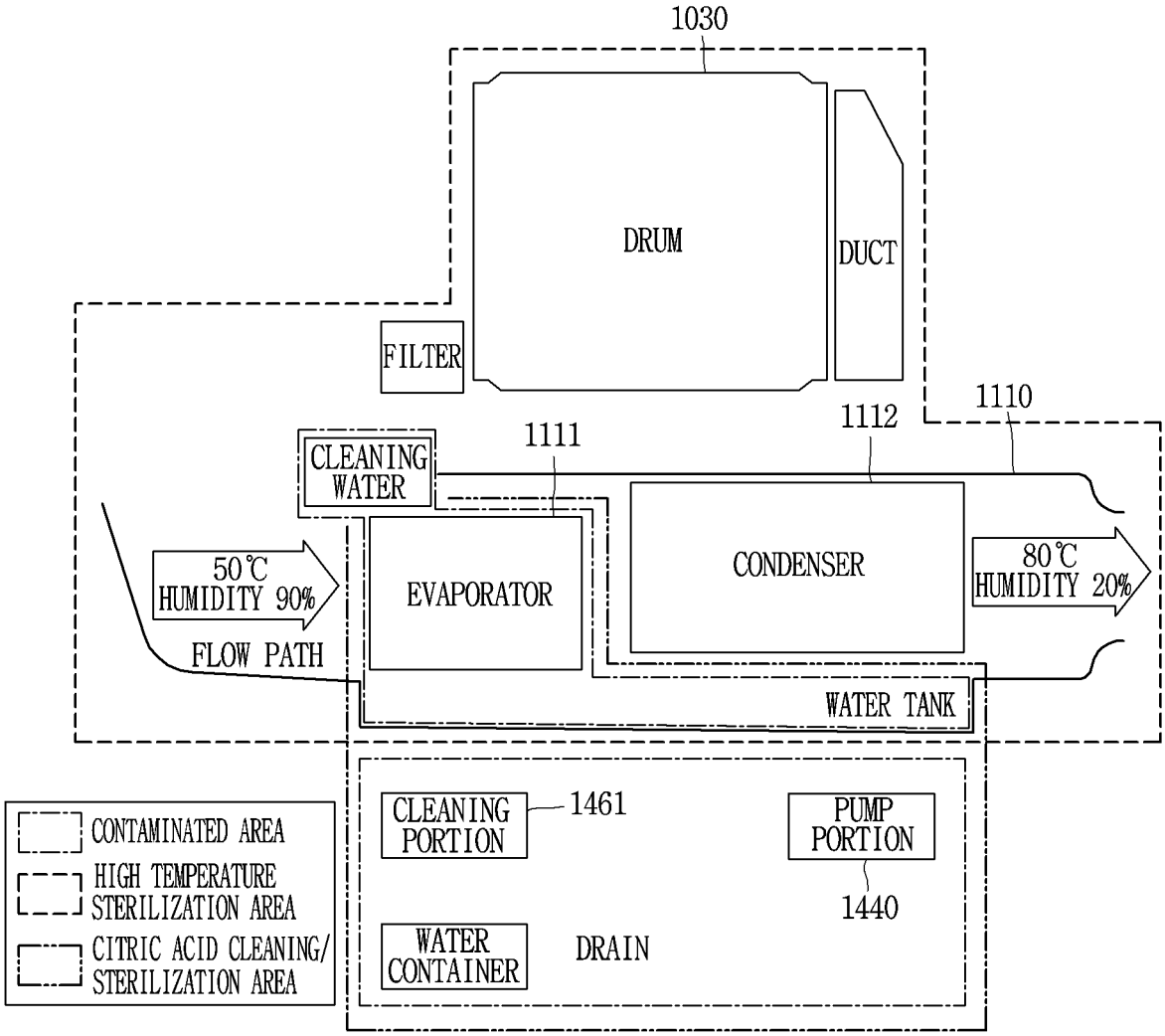
FIG. 18B is a conceptual view illustrating cleaning and sterilization ranges of the first operation mode as illustrated in FIG. 18A.
Figure 19A:
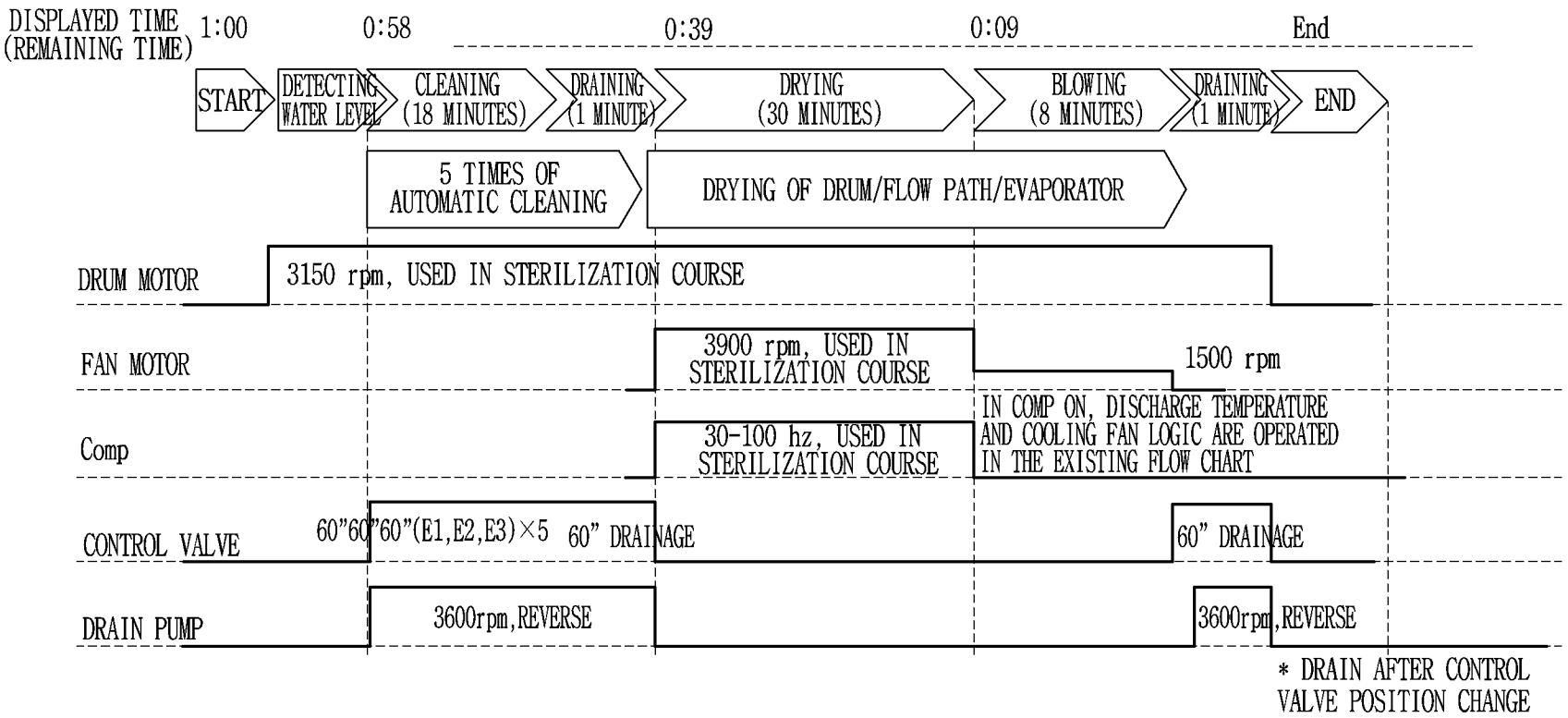
FIG. 19A is an exemplary view illustrating an example of a second operation mode for explaining a detailed application example of an evaporator sterilization method related to an embodiment.
Figure 19B:
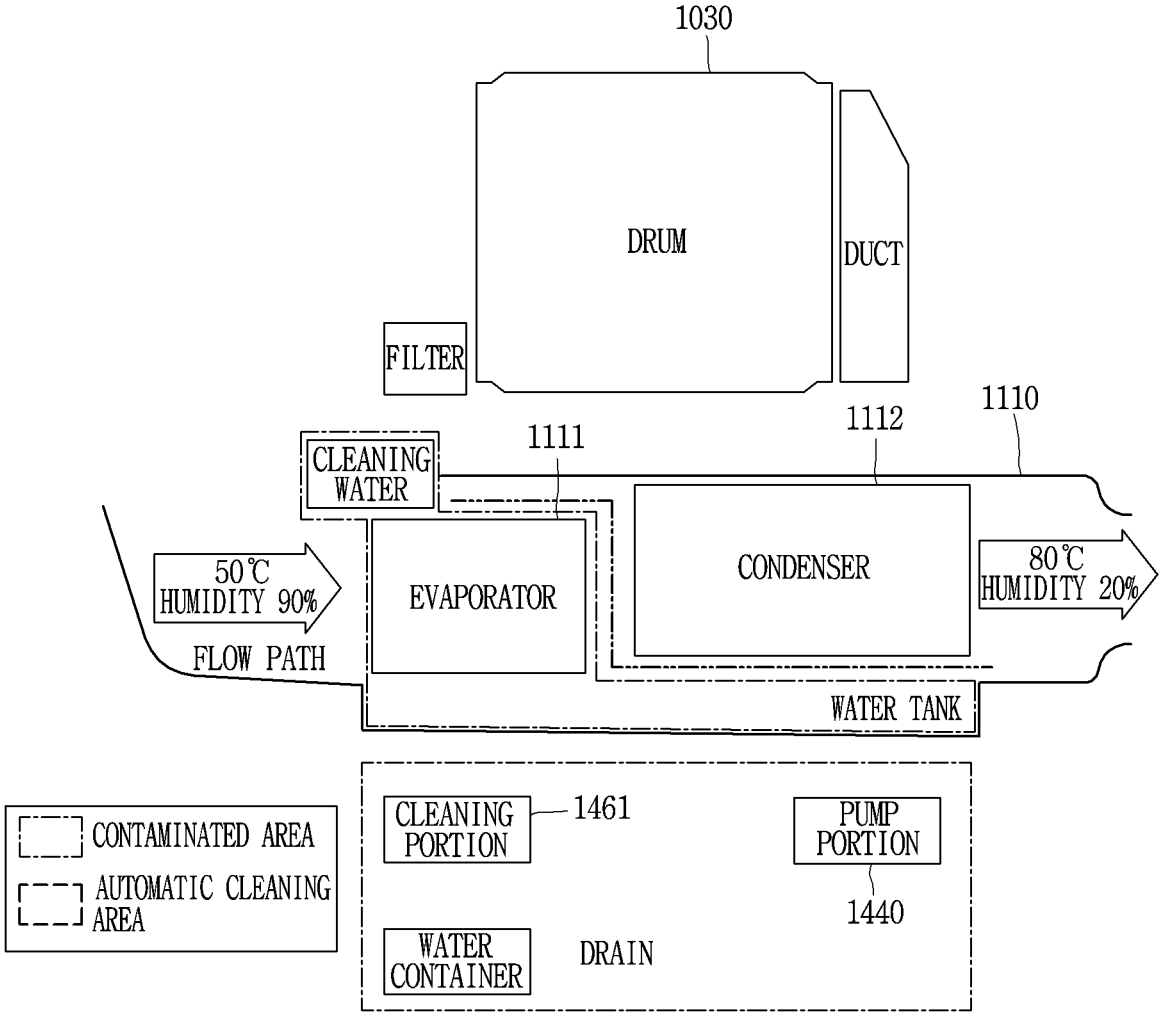
FIG. 19B is a conceptual view illustrating cleaning and sterilization ranges of the second operation mode as illustrated in FIG. 19A.

For example, the evaporator sterilization may be performed in a first operation mode in which the entire clothes treating apparatus 1000 is cleaned and sterilized as illustrated in FIGS. 18A and 18B, and may be performed in a second operation mode in which the evaporator 1111 is cleaned and sterilized as illustrated in FIGS. 19A and 19B.

The first operation mode is a mode in which the clothes treating apparatus 1000 operates as illustrated in FIG. 18A to clean and sterilize the entire clothes treating apparatus 1000 as illustrated in FIG. 18B. When the first operation mode is started in the no-load state, the first operation mode may be performed in the following order of courses, such as an automatic cleaning and sterilizing course in which cleaning water containing citric acid is sprayed on the evaporator 1111 and the water tank according to a predetermined reference for spraying, a drum/flow path high-temperature sterilization course in which the drum 1030 and the air circulation passage is sterilized at a high temperature, and an evaporator high-temperature sterilization course in which the evaporator 1111 is sterilized at a high temperature. Here, in the automatic cleaning sterilizing course, the evaporator 1111 is cleaned before being sterilized by controlling the valve portion 391 to allow the cleaning water is sprayed on the evaporator 1111 according to the predetermined reference for spraying. Thereafter, when a predetermined time has elapsed after driving the compressor 1120 and the circulation fan 1710, the operation of the compressor 1120 and the circulation fan 1710 is stopped, and the pump portion 1440 is controlled to drain the condensate so that the condensate collected after the cleaning is drained. After that, the drum/flow path high-temperature sterilization course is started by driving the compressor 1120 and the circulation fan 1710, so that the drying of the drum 1030 and the evaporator 1111 is performed. Thereafter, when at least one of the temperature change and the operating state corresponds to a predetermined reference condition, the evaporator high-temperature sterilization course can be started by stopping the operation of the compressor 1120. In the evaporator high-temperature sterilization course, the evaporator 1111 can be sterilized at or above the reference temperature by stopping the operation of the compressor 1120 so that the surface temperature of the evaporator 1111 stays at or above the reference temperature for the reference time. Here, as the circulation fan 1710 is operated by changing the rotation speed of the circulation fan 1710, the surface temperature can be stayed at or above the reference temperature due to the blowing of the circulation fan 1710. And, the condensate collected in the drum/flow path high-temperature sterilization course can be drained by controlling the pump portion 1440 so that the condensate is drained after the operation of the compressor 1120 is stopped.

The second operation mode is a mode in which the clothes treating apparatus 1000 operates as illustrated in FIG. 19A to intensively clean and sterilize the evaporator 1111 as illustrated in FIG. 19B. When the second operation mode is started in the no-load state, the second operation mode may be performed in the following order of courses, such as an automatic cleaning course in which cleaning water is sprayed on the drum 1030, the air circulation passage, and the evaporator 1111 according to a predetermined reference for spraying, and a drum/flow path/evaporator drying course in which the drum 1030, the air circulation passage, and the evaporator 1111 are sterilized at a high temperature. Here, in the automatic cleaning course, the evaporator 1111 is cleaned before being sterilized by controlling the valve portion 391 to allow the cleaning water to be sprayed on the evaporator 1111 according to the predetermined reference for spraying while the drum 1030 is operating. In this case, the spraying of the cleaning water may be performed multiple times, for example, may be performed 5 times or more. Thereafter, by driving the compressor 1120 and the circulation fan 1710, the drum/flow path/evaporator drying course may be started. In the drum/flow path/evaporator drying course, the evaporator 1111 can be sterilized at or above the reference temperature by operating the compressor 1120 until at least one of the temperature change and the operating state corresponds to the reference condition, then stopping the operation of the compressor 1120 so that the surface temperature stays at or above the reference temperature. Here, as the circulation fan 1710 is operated by changing the rotation speed of the circulation fan 1710, the surface temperature can stay at or above the reference temperature due to the blowing of the circulation fan 1710. And, the condensate collected in the drum/flow path/evaporator drying course can be drained by controlling the pump portion 1440 so that the condensate is drained after the operation of the compressor 1120 is stopped.

The first operation mode and the second operation mode are examples for explaining a detailed application example of an evaporator sterilization method according to an embodiment. The first operation mode and the second operation mode may be performed in an order/course/method different from the ones illustrated in FIGS. 18A and 19A. Also, the detailed application example of the evaporator sterilization method according to an embodiment may be performed in a method in which the first operation mode and the second operation mode illustrated in FIGS. 18A and 19A are modified.

Embodiments of the apparatus for controlling the clothes treating apparatus, the clothes treating apparatus, and the method for controlling the clothes treating apparatus described above may be performed separately, and may also be performed in a combination of two or more.

Embodiments of the apparatus for controlling the clothes treating apparatus, the clothes treating apparatus, and the method for controlling the clothes treating apparatus described above may be implemented in a part or a combination of configurations or steps included in each embodiment, or may be implemented in a combination of the embodiments.

Embodiments of the apparatus for controlling the clothes treating apparatus, the clothes treating apparatus, and the method for controlling the clothes treating apparatus described above may be applied to a control apparatus, a control module, and a control means controlling the clothes treating apparatus, a method for controlling the control apparatus that controls the clothes treating apparatus, a method for controlling the clothes treating apparatus, or a control system of the clothes treating apparatus, etc.

Embodiments of the apparatus for controlling the clothes treating apparatus, the clothes treating apparatus, and the method for controlling the clothes treating apparatus described above may be usefully applied to, in particular, a sterilization method for the control apparatus of the clothes treating apparatus, a sterilization method for the clothes treating apparatus, a sterilizing operation method for the clothes treating apparatus, or a method for controlling the sterilizing operation of the clothes treating apparatus.

Embodiments of the apparatus for controlling the clothes treating apparatus, the clothes treating apparatus, and the method for controlling the clothes treating apparatus described above may also be applied to all the clothes treating apparatus, dryers, a control method for the clothes treating apparatus, a control method for operation of the clothes treating apparatus to which a technical idea of the above technology can be applied.

Detailed embodiments of the present disclosure have been described so far, but various modifications may be applicable within a scope of the present disclosure. Therefore, the scope of the present disclosure may not be limited to the described embodiments, but may be determined not only by the claims below but also by the equivalents of the claims.

As mentioned above, although the present disclosure has been described by way of limited embodiments and drawings, but is not limited to the above-described embodiments, which can be adjusted or modified by those skilled in the art to which the present disclosure pertains. Accordingly, it will be said that all of the equivalent or equivalent modifications thereof fall within the scope of the idea of the present disclosure.

What is claimed is:

1. A clothes treating apparatus, comprising:

a drum located in a main body of the clothes treating apparatus;

a heat exchanger that is located at an air circulation passage connected to the drum and that includes an evaporator and a condenser, the heat exchanger being configured to exchange heat with air circulating in the air circulation passage;

a compressor configured to compress a refrigerant that is circulated through the heat exchanger and that exchanges heat with air circulating in the air circulation passage;

one or more input elements configured to receive control input for selection of an operation mode of the clothes treating apparatus; and a control apparatus configured to control at least one of operation of the drum or operation of the compressor to perform the selected operation mode based on the control input;

wherein the control apparatus is further configured to:

based on the selected operation mode being a specific mode to control a surface temperature of the evaporator, drive the compressor, and based on at least one of a temperature change of the evaporator or an operating state of the compressor meeting a predetermined reference condition, stop the compressor to maintain the surface temperature at or above a predetermined reference temperature.

2. The clothes treating apparatus of claim 1, wherein, in the specific mode, the drum is empty.

3. The clothes treating apparatus of claim 2, wherein the control apparatus is further configured to, based on an object for drying being accommodated in the drum, allow selection of the specific mode but block an operation that corresponds to the specific mode.

4. The clothes treating apparatus of claim 1, wherein the one or more input elements comprise at least one of:

an input unit configured to control operation of the clothes treating apparatus, a button portion configured to apply a push operation to perform the specific mode, a voice portion configured to input voice to control operation of the clothes treating apparatus, or a communication unit configured to enable the clothes treating apparatus to receive control input from an external device.

5. The clothes treating apparatus of claim 1, wherein the control apparatus is further configured to, based on the operation of the compressor being stopped, stop the operation of the compressor for a predetermined reference time.

6. The clothes treating apparatus of claim 1, further comprising:

a circulation fan that is controlled by the control apparatus and that is configured to generate a flow of air through the condenser and the drum, wherein the control apparatus is further configured to operate the circulation fan based on the operation of the compressor being stopped.

7. The clothes treating apparatus of claim 1, further comprising:

a pump configured to drain condensate collected in a water tank to outside of the water tank, the water tank being located at a lower side of the heat exchanger, wherein the control apparatus is further configured to control the pump to drain the condensate after the operation of the compressor is stopped and before the operation of the compressor is started.

8. A method for controlling a clothes treating apparatus that comprises a heat exchanger that is located at an air circulation passage connected to a drum and that includes an evaporator and a condenser, the heat exchanger being configured to exchange heat with air circulating in the air circulation passage; a compressor configured to compress a refrigerant; and a circulation fan configured to generate a flow of air through the condenser and the drum, the method comprising:

driving the compressor and the circulation fan;

stopping, based on at least one of a temperature change of the evaporator or an operating state of the compressor, operation of the compressor to meet a predetermined reference condition;

maintaining the stopping of operation of the compressor for a predetermined reference time; and repeating operations comprising:

driving the compressor and the circulation fan, and stopping operation of the compressor and maintaining the stopping of operation of the compressor.

9. The method of claim 8, wherein maintaining the stopping of operation of the compressor comprises driving the circulation fan after stopping operation of the compressor.

* * * * *